US009567157B2

(12) United States Patent
Scudder et al.

(10) Patent No.: US 9,567,157 B2
(45) Date of Patent: Feb. 14, 2017

(54) SYSTEMS AND METHODS FOR PACKAGING AND TRANSPORTING BULK MATERIALS

(75) Inventors: Erik D. Scudder, New York, NY (US); Shonagh Eva Adelman, Miami, FL (US)

(73) Assignee: Intermodal Sciences, LLC, New York, NY (US)

( * ) Notice: Subject to any disclaimer, the term of this patent is extended or adjusted under 35 U.S.C. 154(b) by 968 days.

(21) Appl. No.: 13/367,911

(22) Filed: Feb. 7, 2012

(65) Prior Publication Data

US 2013/0036711 A1 Feb. 14, 2013

Related U.S. Application Data

(60) Provisional application No. 61/440,202, filed on Feb. 7, 2011.

(30) Foreign Application Priority Data

Sep. 9, 2011 (GB) ..... 1115601.5

(51) Int. Cl.

| | |
|---|---|
| ***B65D 90/04*** | (2006.01) |
| ***B65D 88/54*** | (2006.01) |
| *B65D 88/12* | (2006.01) |

(52) U.S. Cl.

CPC ..... *B65D 88/548* (2013.01); *B65D 88/54* (2013.01); *B65D 90/048* (2013.01); *B65D 88/121* (2013.01); *B65D 90/046* (2013.01); *B65D 2588/746* (2013.01)

(58) Field of Classification Search

CPC ..... B65D 88/22; B65D 88/16; B65D 88/1612; B65D 88/1631; B65D 90/04; B65D 90/046; B65D 90/047; B65D 88/12; B65D 2590/046

USPC ..... 53/469, 133.1, 133.3, 138.1, 139.2,53/133.4; 220/1.6

See application file for complete search history.

(56) References Cited

U.S. PATENT DOCUMENTS

| | | | |
|---|---|---|---|
| 2,696,235 | A | 12/1954 | Toffolon |
| 3,214,221 | A | 10/1965 | Finnegan |
| 3,306,675 | A | 2/1967 | Fritz |
| 3,868,042 | A | 2/1975 | Bodenheimer |

(Continued)

FOREIGN PATENT DOCUMENTS

| | | | |
|---|---|---|---|
| CN | 2711057 | Y | 7/2005 |
| EP | 0635439 | A1 | 1/1995 |

(Continued)

OTHER PUBLICATIONS

International Preliminary Report on Patentability for International Patent Application No. PCT/US2012/024112, mailed Aug. 22, 2013.

(Continued)

*Primary Examiner* — Christopher Harmon
(74) *Attorney, Agent, or Firm* — Cooley LLP

(57) ABSTRACT

A flexible container includes a container body and a flexible cover. The container body defines an interior volume and includes a side wall that defines an opening. The opening is configured to receive a bulk material therethrough such that the bulk material can be disposed within an interior volume of the container body. The flexible cover can be coupled to the side wall about the opening. The cover is configured to fluidically isolate the interior volume from a volume substantially outside of the flexible container.

33 Claims, 20 Drawing Sheets

(56) References Cited

U.S. PATENT DOCUMENTS

| | | | | |
|---|---|---|---|---|
| 3,917,354 | A | 11/1975 | Adams, Jr. et al. | |
| 3,951,284 | A | 4/1976 | Fell et al. | |
| 4,054,161 | A | 10/1977 | Alack | |
| 4,101,292 | A | 7/1978 | Hogan, II | |
| 4,232,803 | A | 11/1980 | Muller et al. | |
| 4,671,733 | A * | 6/1987 | Krein | B65D 90/046 105/355 |
| 4,674,127 | A | 6/1987 | Yamada et al. | |
| 4,872,493 | A | 10/1989 | Everman | |
| 4,911,317 | A * | 3/1990 | Schloesser | B65D 90/046 220/1.5 |
| 4,941,589 | A | 7/1990 | Chen | |
| 4,966,310 | A | 10/1990 | Hawkins | |
| 5,040,693 | A | 8/1991 | Podd, Sr. et al. | |
| 5,195,197 | A | 3/1993 | Gutierrez et al. | |
| 5,199,826 | A | 4/1993 | Lawrence | |
| 5,244,332 | A | 9/1993 | Krein et al. | |
| 5,332,095 | A | 7/1994 | Wu | |
| 5,547,331 | A | 8/1996 | Podd et al. | |
| 5,553,639 | A | 9/1996 | Erickson | |
| 5,564,599 | A | 10/1996 | Barber et al. | |
| 5,938,338 | A | 8/1999 | McDonough | |
| 5,983,957 | A | 11/1999 | Erickson | |
| 6,109,786 | A | 8/2000 | Hafer et al. | |
| 6,132,088 | A * | 10/2000 | Suzuki | B65D 90/046 220/482 |
| 6,186,713 | B1 | 2/2001 | Bonerb | |
| 6,286,700 | B1 | 9/2001 | Davidson | |
| 6,447,826 | B1 * | 9/2002 | Matthews | A23B 4/16 426/126 |
| 6,454,496 | B1 | 9/2002 | Mills et al. | |
| 6,467,955 | B1 | 10/2002 | Kim | |
| 6,477,970 | B1 * | 11/2002 | Ayorinde | B63B 25/00 114/73 |
| 6,478,517 | B1 | 11/2002 | Nelson et al. | |
| 6,550,645 | B2 | 4/2003 | Nelson et al. | |
| 6,575,629 | B1 | 6/2003 | Perkins | |
| 7,434,520 | B2 | 10/2008 | Zupancich et al. | |
| 8,141,328 | B2 * | 3/2012 | Villers | B65D 88/1606 53/139.2 |
| 8,287,791 | B2 | 10/2012 | Stackpole | |
| 8,313,268 | B2 | 11/2012 | Kords et al. | |
| 8,418,731 | B2 | 4/2013 | Kords et al. | |
| 8,662,341 | B2 | 3/2014 | Kohen | |
| 8,690,021 | B2 | 4/2014 | Asraf | |
| 9,090,392 | B2 | 7/2015 | Loeschen et al. | |
| 9,394,105 | B2 | 7/2016 | Li | |
| 2002/0164093 | A1 | 11/2002 | Burkhardt | |
| 2003/0197009 | A1 | 10/2003 | Mino | |
| 2006/0175324 | A1 | 8/2006 | Podd | |
| 2006/0186117 | A1 | 8/2006 | Podd | |
| 2006/0251343 | A1 | 11/2006 | True | |
| 2007/0021774 | A1 | 1/2007 | Hogendijk | |
| 2007/0023438 | A1 | 2/2007 | Kenneth, Jr. | |
| 2007/0102428 | A1 * | 5/2007 | Eamcharoenying | B65D 88/62 220/1.6 |
| 2007/0201774 | A1 | 8/2007 | Plunkett et al. | |
| 2008/0179330 | A1 | 7/2008 | Brooks et al. | |
| 2008/0190918 | A1 | 8/2008 | Bellmore | |
| 2008/0307755 | A1 * | 12/2008 | Stelliferi | B65B 31/00 53/469 |
| 2009/0087609 | A1 | 4/2009 | Masui et al. | |
| 2009/0234317 | A1 | 9/2009 | Navarro | |
| 2009/0277566 | A1 | 11/2009 | Lawrence et al. | |
| 2010/0122981 | A1 | 5/2010 | Sims | |
| 2010/0147728 | A1 | 6/2010 | Guiles et al. | |
| 2010/0270297 | A1 | 10/2010 | Villers et al. | |
| 2011/0027018 | A1 | 2/2011 | Baker et al. | |
| 2011/0083768 | A1 | 4/2011 | Sims et al. | |
| 2011/0198368 | A1 | 8/2011 | Asraf | |
| 2011/0240652 | A1 | 10/2011 | Kohen | |
| 2013/0098785 | A1 | 4/2013 | Steffens | |
| 2013/0101237 | A1 | 4/2013 | Kohen | |
| 2013/0239523 | A1 | 9/2013 | Scudder et al. | |
| 2016/0355332 | A1 | 12/2016 | Scudder et al. | |

FOREIGN PATENT DOCUMENTS

| | | | |
|---|---|---|---|
| EP | 0 538 563 | B1 | 4/1997 |
| EP | 0771 738 | A1 | 5/1997 |
| EP | 1 252 011 | B1 | 4/2005 |
| GB | 2153798 | A | 8/1985 |
| GB | 2461934 | A | 1/2010 |
| WO | WO 2006/046038 | A2 | 5/2006 |
| WO | WO2007/112383 | A1 | 10/2007 |
| WO | WO 2010/046790 | A1 | 4/2010 |
| WO | WO 2012/016077 | A1 | 2/2012 |
| WO | WO 2016/196938 | A1 | 12/2016 |

OTHER PUBLICATIONS

International Search Report and Written Opinion for International Patent Application No. PCT/US2013/040091, mailed Sep. 5, 2013.

Chinese Office Action for the application 201280013940.3, issued Sep. 17, 2014.

LiquaTrans, T-Flex // Trailer Flexitank, [retrieved from the Internet] [retrieved on Jan. 26, 2015 at URL: http://www.liquatrans.com/en/liquid_bulk/detay/t-flex-trailer-flexitank/3/.

Chinese Second Office Action for the application 201280013940.3, issued Mar. 6, 2015.

Chinese Office Action for the application 201380036572.9, issued Jan. 22, 2016.

Office Action for U.S. Appl. No. 13/889,654, mailed Feb. 11, 2016.

Search and Exam Report for British Patent Application GB 1600664.5, mailed Feb. 23, 2016.

Examination Report for British Patent Application GB 1202085.5, mailed Mar. 9, 2016.

Examination Report for British Patent Application GB 1600663.7, mailed Mar. 9, 2016.

Examination Report for Australian Application AU 2012214554, mailed Jun. 6, 2016.

Examination Report for Australian Application AU 2013259629, mailed Jun. 8, 2016.

Examination Report for British Patent Application GB 1600664.5, mailed Jun. 23, 2016.

Search Report for GB 1202085.5, mailed Apr. 25, 2012.

International Search Report and Written Opinion for International Patent Application No. PCT/US2016/035725, mailed Nov. 7, 2016.

Office Action for U.S. Appl. No. 13/889,654, mailed Oct. 20, 2016.

* cited by examiner

SYSTEMS AND METHODS FOR PACKAGING AND TRANSPORTING BULK MATERIALS

CROSS-REFERENCE TO RELATED APPLICATIONS

This application claims priority to United Kingdom Patent Application Serial No. 1115601.5, entitled "Transport of Granular Materials," filed Sep. 9, 2011, which is incorporated herein by reference in its entirety. This application claims priority to U.S. Provisional Application Ser. No. 61/440,202, entitled "Containerized Coal," filed Feb. 7, 2011, which is incorporated herein by reference in its entirety

BACKGROUND

The embodiments described herein relate to systems and methods for packaging and transporting a bulk material. More particularly, the embodiments described herein relate to systems and methods for packaging and transporting coal within a flexible container.

Recent reports indicate that the United States has about 263,781 billion tons of recoverable coal. Yet, surprisingly, the U.S. exports only approximately 90 million tons per year. In contrast, Russia exports 116 million tons per year out of its estimated 173,074 billion tons of recoverable coal, and Australia exports 259 million tons per year even though it is estimated to have only one-third of the recoverable tons of the United States (84,437 billion tons).

One reason why the U.S. exports so little coal is because known transportation facilities and methods limit the ability to ship coal. According to known methods, coal is transported in its raw form via bulk carrier vessels (for intercontinental transport), and via open rail cars, barges, slurry pipelines and trucks (for intra-continental transport). Numerous factors limit the capacity of such transport means, including the lack of suitable deep draught ports and limited availability of coal handling facilities that can handle hazardous materials.

Known bulk transport processes utilized in the United States and other coal producing countries are also inefficient and environmentally unsound. In particular, after extraction, coal is typically loaded onto open trucks using construction equipment and conveyor systems, and then transported to a railhead. At the railhead, the coal is unloaded and stored outdoors in large open piles until further transport is arranged at a later point in time. When further transport is scheduled, the coal is reloaded onto available trains, typically in open, bulk rail cars.

When coal is destined for overseas locations, such as Asia, it is conveyed by rail car to ports that can handle bulk materials. According to known methods, at these ports, coal is unloaded and stored outdoors in large open piles until it is scheduled for loading on a vessel. Once a vessel arrives for transporting the coal, the coal is loaded onto one or more bulk holds of the vessel. Once the vessel arrives at its destination port, the coal is unloaded, stored and reloaded for further transport by land or rail to the generating plant or another end user. At the generating plant, the coal is again unloaded and stored outdoors in a large open pile, where it remains until it is needed. Thus, at multiple stages during known methods of transportation, coal is loaded, unloaded, stored, and reloaded. This repetitive loading, unloading, storage and re-loading of bulk material is highly inefficient.

Further, at each stage in the transportation process, coal is exposed to air and earth. Such practices are environmentally unsound, as coal dust is environmentally hazardous. Moreover, highly acidic materials can leach from storage piles into nearby aquifers. In addition, product is lost to the effects of wind and rain, having a negative economic impact.

The lack of deep-water ports can also be a limiting factor in the export of coal using known methods. For example, there are a limited number of deep-water ports throughout the U.S., particularly the west coast. Although most all U.S. ports can typically accommodate bulk vessels of the Handy class, which typically have a capacity in the range of 35-40,000 tons, most U.S. ports cannot accommodate larger bulk transport ships vessels. For example, most U.S. ports cannot accommodate large draught vessels, such as Panamax vessels (with a capacity in the range of 60-80,000 tons) and Cape vessels (with a capacity of 100-150,000 or more tons). While many west coast ports are seeking to expand their ability to accommodate larger bulk ships, these efforts have been delayed or prevented by cost, environmental laws and regulations, and community-based concerns. As a result, coal suppliers and exporters have had no choice but to incur the high costs associated with transport via Handy sized vessels through busy ports, shipping via Canadian ports or topping off in Canadian and other country's ports.

Until recently, Asian countries have been supplied with the majority of their coal requirements from China, Australia, Indonesia, South Africa and Russia. Because China has now become a net importer of coal, however, there is increased demand for large bulk carrier capabilities, and several port initiatives have been undertaken to address these deficiencies. Unfortunately, these initiatives, which are often related to changes in the infrastructure related to shipping, are costly, long-term projects that are facing increasing local and national concerns over the environmental impact of current handling and transport methods for coal.

Known bulk transport methods are also limited in their ability to deliver different grades of material, including value-added forms of coal, such as processed coal. Specifically, when transported by bulk carrier according to known methods, it is difficult to segregate materials, and to maintain their quality. While bulk transport methods may be acceptable for transport of raw coal, they are often not adequate for transport of a variety of forms of processed coal to multiple end users, except by inclusion in fluidized beds or pipelines. However, fluidized beds and pipelines are expensive to construct, maintain and/or utilize.

Although intermodal containerization of goods has made transportation of goods significantly more efficient than other transportation methods, bulk commodities, such as coal, have not been able to benefit from the intermodal containerized transport systems for a variety of reasons. For example, one such reason is that coal is subject to spontaneous combustion when exposed to air and pressure. Thus, shipping coal by container according to known systems and methods can increase the likelihood of spontaneous combustion.

Thus a need exists for improved systems and methods packaging and transporting a bulk material.

SUMMARY

Apparatus, systems, and methods for housing a bulk material within a flexible container are described herein. In some embodiments, a flexible container includes a container body and a flexible cover. The container body defines an interior volume and includes a side wall that defines an opening. The opening is configured to receive a bulk material therethrough such that the bulk material can be disposed within an interior volume of the container body. The flexible cover can be coupled to the side wall about the opening. The cover is configured to fluidically isolate the interior volume from a volume substantially outside of the flexible container.

DETAILED DESCRIPTION

Figure 1:
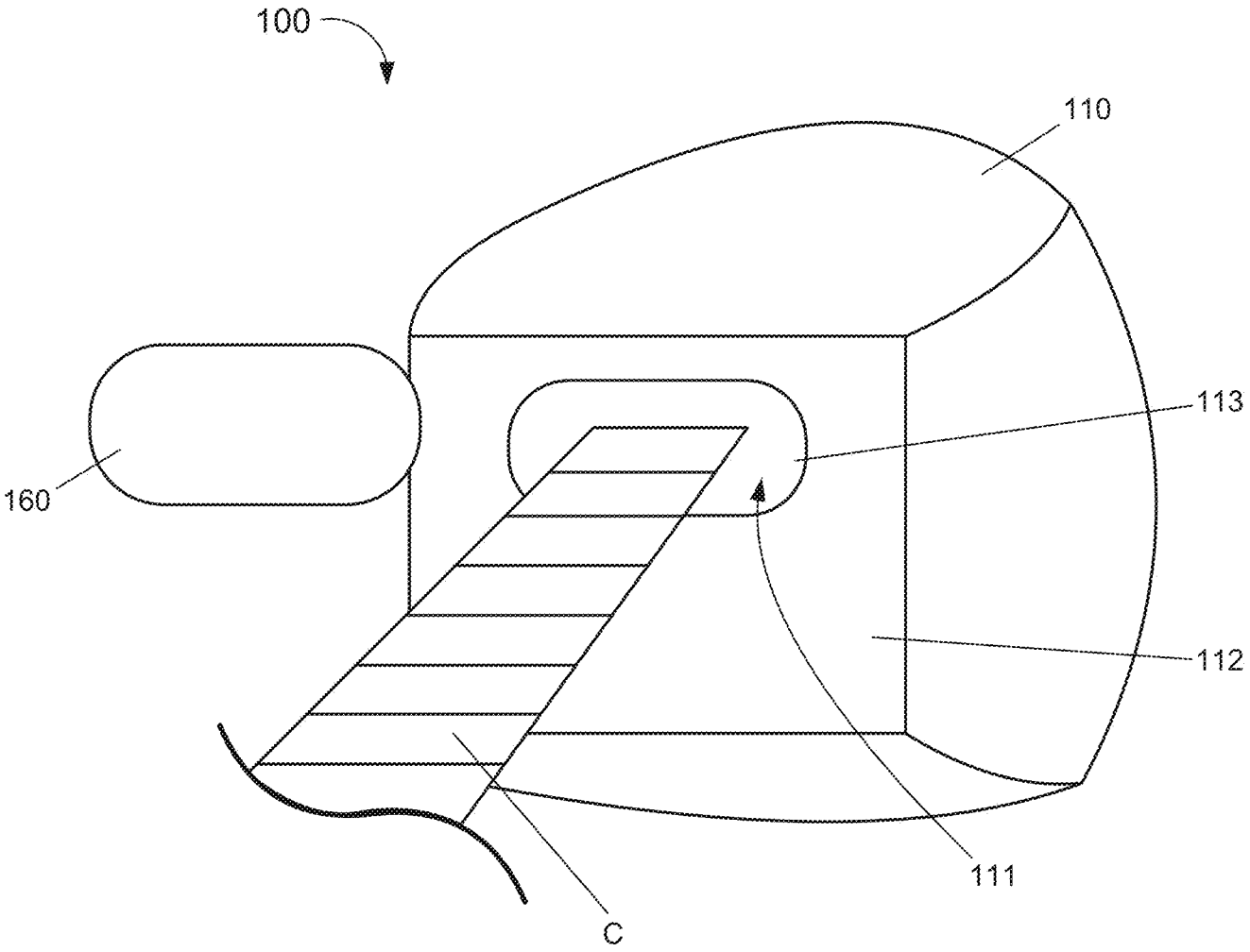
FIG. 1 is a schematic illustration of a flexible container, according to an embodiment in an expanded configuration while being filled with a bulk material.

Apparatus, systems, and methods for housing a bulk material within a flexible container are described herein. In some embodiments, a flexible container includes a container body and a flexible cover. The container body defines an interior volume and includes a side wall that defines an opening. The opening is configured to receive a bulk material therethrough such that the bulk material can be disposed within an interior volume of the container body. In some embodiments, for example, the opening can have a non-circular shape to accommodate a delivery member, such as a coal conveyer. The flexible cover can be coupled to the side wall about the opening. The cover is configured to fluidically isolate the interior volume from a volume substantially outside of the flexible container.

In some embodiments, a flexible container includes a first portion, constructed from a first material, and a second portion, constructed from a second material. The flexible container defines an interior volume and is placed in an expanded configuration when the interior volume receives a bulk material, such as, for example raw or processed coal. The flexible container is configured to be moved from the expanded configuration to a collapsed configuration when the bulk material is disposed within the interior volume via a reduction in pressure within the interior volume. The first portion is configured to deform a first amount when the flexible container is moved from the expanded configuration to the collapsed configuration. The second portion is configured to deform a second amount, substantially different than the first amount.

In some embodiments, a system includes a rigid shipping container and a flexible container configured to be coupled within the rigid shipping container. The flexible container defines an interior volume and can be placed in an expanded configuration when the interior volume receives a bulk material. The flexible container is configured to be moved from the expanded configuration to a collapsed configuration when the bulk material is disposed within the interior volume via a reduction in pressure within the interior volume. The system further includes at least one flexible tether configured to anchor the flexible container within the rigid shipping container to form the system. The system is devoid of a dunnage bag and/or a bulwark. Similarly stated, the bulk material can be coupled within the rigid shipping container solely via the at least one flexible tether.

In some embodiments, a system includes a rigid shipping container and a flexible container configured to be coupled within the rigid shipping container. The flexible container defines an interior volume and can be placed in an expanded configuration when the interior volume receives a bulk material. The flexible container is configured to be moved from the expanded configuration to a collapsed configuration when the bulk material is disposed within the interior volume via a reduction in pressure within the interior volume. The system further includes at least one tether including a first portion and a second portion. The first portion is configured to be coupled to the flexible container. The second portion is configured to be coupled to the rigid shipping container. The tether defines a length configured to change when the flexible container is moved between the expanded configuration and the collapsed configuration.

In some embodiments, a method includes conveying a bulk material into an interior volume of a flexible container via an opening defined by the flexible container. The method further includes coupling a cover about the opening to fluidically isolate the interior volume from a volume outside the flexible container. The method further includes reducing the pressure within the interior volume after the cover is coupled to the flexible material to move the flexible container into a collapsed configuration. In this manner, the bulk material and the flexible container can collectively form a substantially solid body that can be handled and/or shipped.

As used herein, the term "flexible" and/or "flexibility" relates to an object's tendency towards deflection, deformation, and/or displacement under an applied force. For example, a material with a greater flexibility is more likely to deflect, deform and/or be displaced when exposed to a force than a material having a lower flexibility. Similarly stated, a material having a higher degree of flexibility can be characterized as being less rigid than a material having a lower degree of flexibility. Flexibility can be characterized in terms of the amount of force applied to the object and the resulting distance through which a first portion of the object deflects, deforms, and/or displaces with respect to a second portion of the object. In certain situations, this can be depicted graphically as a stress-strain curve. When characterizing the flexibility of an object, the deflected distance may be measured as the deflection of a portion of the object different than the portion of the object to which the force is directly applied. Said another way, in some objects, the point of deflection is distinct from the point where force is applied.

Flexibility is an extensive property of the object being described, and thus is dependent upon the material from which the object is formed and certain physical characteristics of the object (e.g., shape of the object, number of plies of material used to construct the object, and boundary conditions). For example, the flexibility of an object can be increased or decreased by selectively including in the object a material having a desired modulus of elasticity, flexural modulus and/or hardness. The modulus of elasticity is an intensive property of (i.e., is intrinsic to) the constituent material and describes an object's tendency to elastically (i.e., non-permanently) deform in response to an applied force. A material having a high modulus of elasticity will not deflect as much as a material having a low modulus of elasticity in the presence of an equally applied force. Thus, the flexibility of the object can be increased, for example, by introducing into the object and/or constructing the object of a material having a relatively low modulus of elasticity.

Similarly, the flexural modulus is used to describe the ratio of an applied stress on an object in flexure to the corresponding strain in the outermost portions of the object. The flexural modulus, rather than the modulus of elasticity, is used to characterize certain materials, for example plastics, that do not have material properties that are substantially linear over a range of conditions. An object with a first flexural modulus is more elastic and has a lower strain on the outermost portions of the object than an object with a second flexural modulus greater than the first flexural modulus. Thus, the flexibility of an object can be increased by including in the object a material having a relatively low flexural modulus.

The flexibility of an object constructed from a polymer can be influenced, for example, by the chemical constituents and/or arrangement of the monomers within the polymer. For example, the flexibility of an object can be increased by decreasing a chain length and/or the number of branches within the polymer. The flexibility of an object can also be increased by including plasticizers within the polymer, which produces gaps between the polymer chains.

As used herein, the terms "expandable," "expanded configuration," "collapsible" and/or "collapsed configuration" relate to a flexible container defining a first cross-sectional area (or volume) and a second cross-sectional area (or volume). For example, a flexible container of the types described herein, can define a larger cross-sectional area (or volume) when in an expanded configuration than the cross-sectional area (or volume) of the flexible container in the collapsed configuration. Expandable components described herein can be constructed from any material having any suitable properties. Such material properties can include, for example, a flexible material having a high tensile strength, high tear resistance, high puncture resistance, a suitable level of compliance (e.g., the expandable components ability to expand appreciably beyond its nominal size) and/or a suitable modulus of elasticity (e.g., as described above).

In some embodiments, for example, an expandable component (e.g., a flexible container) can include at least a portion constructed from a high-compliant material configured to significantly elastically deform when expanded. In other embodiments, an expandable component (e.g., the flexible container) can include at least a portion constructed from a low-compliant material (e.g., a material configured to expand without significant elastic deformation). The compliance of an expandable component defining, for example, an interior volume, is the degree to which a size of the expandable component (in an expanded state) changes as a function of the pressure within the interior volume. For example, in some embodiments, the compliance of a flexible container can be used to characterize the change in the diameter or perimeter length of the expanded flexible container as a function of the pressure within the interior volume defined by the flexible component. In some embodiments, the diameter or perimeter length of an expanded component characterized as a low-compliant component can change by zero to ten percent over the range of pressure applied to the interior volume thereof (e.g., either a positive pressure or a vacuum). In other embodiments, the diameter or perimeter length of an expanded component characterized as a high-compliant component can change as much as 30 percent, 50 percent, 100 percent or greater.

Because the overall characteristics of a flexible container, including the compliance, can be a function of both the material from which the flexible container is constructed and the structural characteristics of the flexible container, the material from which the flexible container is constructed can be selected in conjunction with the desired structural characteristics of the flexible container. For example, in some embodiments, a flexible container can include a first portion defining a first compliance and/or flexibility and a second portion defining a second compliance and/or flexibility. In such embodiments, it can be desirable that the first portion (e.g., a bottom portion) include a lower compliance and/or greater stiffness than the second portion (e.g., a top portion). Thus, the first portion of the flexible container can be configured to deform less under increased or decreased pressure within an interior volume than the second portion. For example, in some embodiments, a force exerted by a bulk material (e.g., the weight of the bulk material) may be such that substantial deformation of the first portion could result in tearing of the material.

As used herein, the term "bulk material" relates to a cargo that is transported in large quantities in the absence of individual packaging. Bulk material and/or bulk cargo can be very dense, corrosive, or abrasive. For example, a bulk material can be bauxite, sand, gravel, copper, limestone, salt, cement, fertilizers, plastic granular, resin powders, coal, grains, iron, gasoline, liquefied natural gas, petroleum, and/or the like. Some bulk materials, for example, coal, can define a low flowability, can be abrasive, can define an uneven weight distribution, and can spontaneously combust. In contrast, a slurry or flowable material can be less abrasive and can be easily distributed. Therefore, handling, packaging and/or shipping of a bulk material can pose different challenges than the handling, packaging and/or shipping of a slurry or flowable material.

FIG. 1 is a schematic illustration of a flexible container 100, according to an embodiment. The flexible container 100 includes a container body 110 and a cover 160 and is configured to move between an expanded configuration (e.g., FIGS. 1 and 2) and a collapsed configuration (e.g., FIG. 3). The flexible container 100 includes a side wall 112 and defines an interior volume 111 within the container body 110. The flexible container 100 can be any suitable shape, size, or configuration. For example, in some embodiments, the flexible container 100 can define an irregular shape as shown in FIG. 1. In other embodiments, a flexible container 100 can have a rectangular prism shape, a cylindrical shape or the like.

The flexible container 100 can be formed from any suitable material or material combination. For example, in some embodiments, the flexible container 100 can be formed from polyethylene, ethylene vinyl acetate (EVOH), amorphous polyethylene terephthalate (APET), polypropylene (PP), high-density polyethylene (HDPE), polyvinylchloride (PVC), polystyrene (PS), polyethylmethacrylate (EMA), metallocene polyethylene (plastomer metallocene), low-density polyethylene (LDPE), high-melt strength (LDPE), ultra-low-density linear polyethylene (ULLDPE), linear low-density polyethylene (LLDPE), K-resin, polybutadiene, and/or mixtures, copolymers, and/or any combination thereof. As used herein the term "copolymer" includes not only those polymers having two different monomers reacted to form the polymer, but two or more monomers reacted to form the polymer.

In some embodiments, the container body 110 can be constructed from multiple layers of material. For example, in some embodiments, the flexible container 100 can include an inner layer and an outer layer. In such embodiments, the inner and/or outer layer can be formed from any suitable material or material combination such as, for example, those described above. In other embodiments, the flexible container 100 can include three or more layers. Furthermore, the layers from which the container body 110 is constructed can be formed from a similar or dissimilar material. For example, in some embodiments, a first layer can be formed from a first material, a second layer can be formed from a second material, and a third layer can be formed from a third material. In other embodiments, one or more layers can be constructed from similar materials.

As shown, the side wall 112 defines an opening 113 having a substantially non-circular shape. The opening 113 is configured to receive a portion of a delivery member C, such as, for example, a conveyer, a chute, a pipe, or the like. In this manner, the delivery member can convey a bulk material (not shown) into the interior volume 111 defined by the container body 110 according to the methods described herein. In some embodiments, the delivery mechanism is a conveyer C configured to transfer coal to the interior volume 111 via the opening 113. In other embodiments, the bulk material can be any suitable material of the types described herein. For example, the bulk material can be phosphate, iron ore, mined ore, grain, and/or the like. In some embodiments, when the bulk material is being conveyed into the interior volume 111, the container body 110 can be maintained in an expanded (or partially expanded) configuration by conveying an inflation fluid (e.g., air, nitrogen or any other suitable gas) into the interior volume. The inflation fluid can be conveyed into the interior volume 111 via the opening 113. Similarly stated the inflation fluid can be conveyed into the interior volume 111 via the same opening through which the bulk material is conveyed. In other embodiments, the container body 110 can be maintained in the expanded (or partially expanded) configuration by any suitable mechanism, such as by attaching the corners of the container body 110 to a rigid structure via tethers and/or cords.

In some embodiments, the conveyer C can be configured to telescope (i.e., change lengths) within the container body 110. For example, in some embodiments, the conveyer C can be disposed through the opening 113 and within the interior volume 111 of the container body 110 such that the conveyer C can transfer the bulk material to a particular location the interior volume 111. In this manner, the container body 110 can be loaded from back to front. Similarly stated, according to this method, when the conveyer C transfers the bulk material to the interior volume 111, the conveyer C can be configured to retract (move from the back portion towards the front portion) with respect to the side wall 112. In this manner, the bulk material can be loaded into the container body 110 evenly (i.e., with a suitable weight distribution) thus reducing load shifting during transport.

Figure 2:
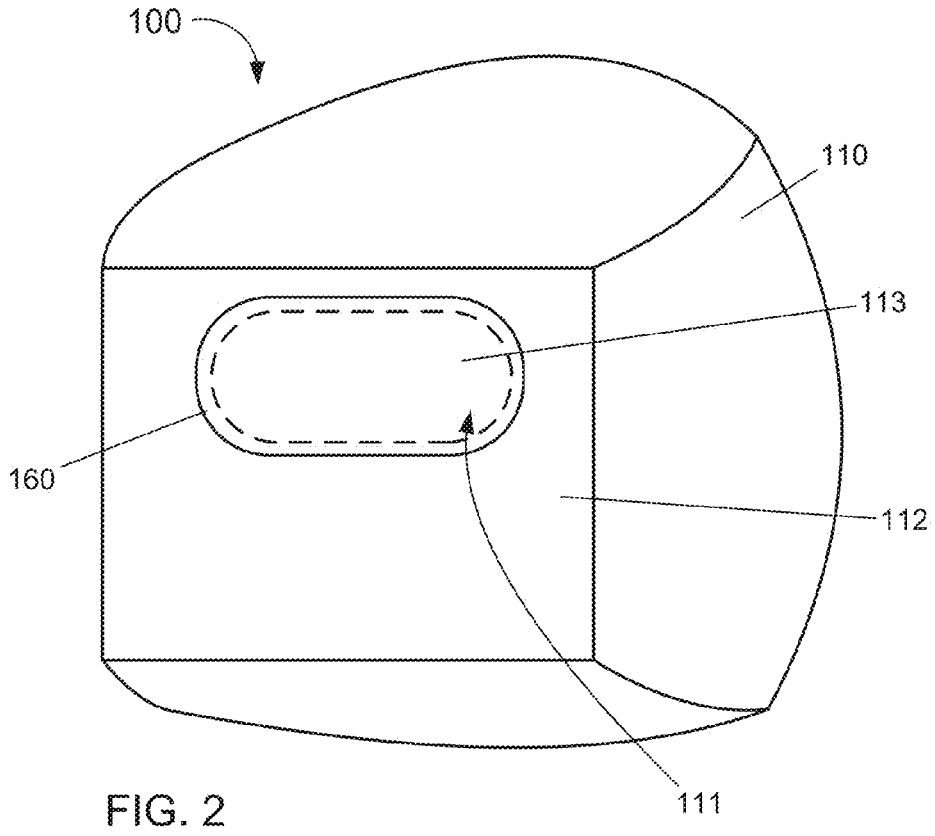
FIG. 2 is a schematic illustration of the flexible container of FIG. 1, in the expanded configuration.

As shown in FIG. 2, after the desired quantity of the bulk material disposed within the interior volume 111 of the container body 110, the conveyer C can be removed from the interior volume 111 via the opening 113. The cover 160 can then be disposed about the opening 113 to fluidically isolate the interior volume 111 from a volume substantially outside the container body 110. Similarly stated, the cover 160 is configured to fluidically seal the container body 110.

The cover 160 can be constructed from any suitable material and can be coupled to the container body 110 by any suitable means. For example, in some embodiments, the cover 160 can be formed from a similar material as at least a portion of the container body 110 (e.g., the cover 160 can be formed from a flexible material). The cover 160 can be coupled to the side wall 112, for example, via an adhesive, adhesive strip, a chemical weld or the like. In other embodiments, the cover 160 can be coupled to the side wall 112 via a zipper style fit. In some embodiments, the cover 160 and the side wall 112 can define a substantially planar surface when the flexible container 100 is in the expanded configuration. In this manner, the container body 110 and the cover 160 can form a substantially continuous surface after the cover 160 is coupled to the container body 110. By avoiding a protruding cover, this arrangement can result in ease of packaging, handling and/or shipping of the flexible container 100.

Figure 3:
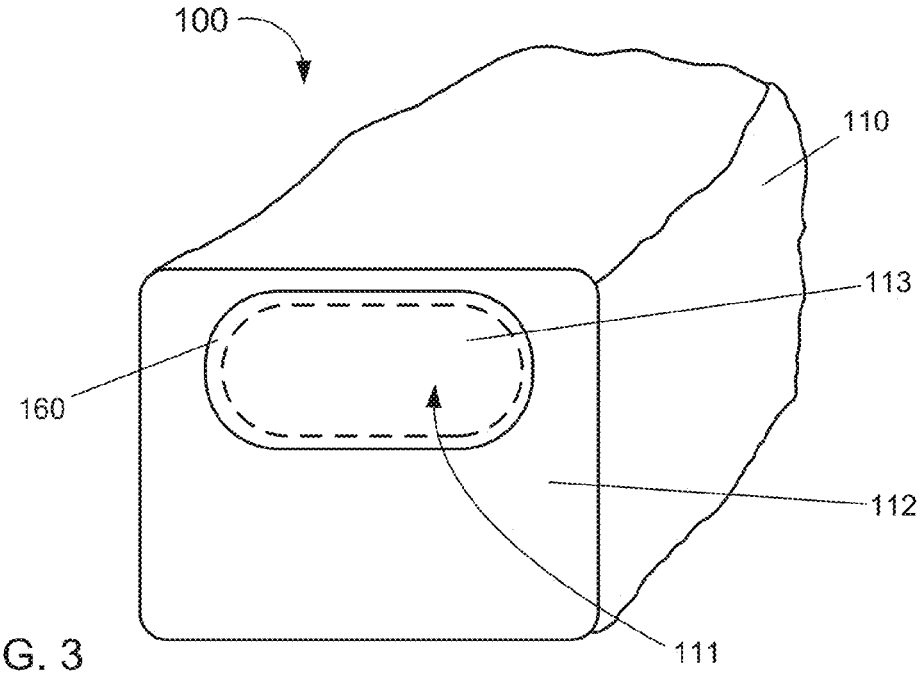
FIG. 3 is a schematic illustration of the flexible container of FIG. 1, in a collapsed configuration.

As shown in FIG. 3, the flexible container 100 can be placed in the collapsed configuration. More specifically, container body 110 and the cover 160 can be placed in the collapsed configuration by evacuating at least a portion of a gas within the interior volume 111 via a port (not shown). In some embodiments, the cover 160 defines the port. In other embodiments, the container body 110 (e.g., the side wall 112) can define the port. In this manner, the port can be engaged by, for example, a vacuum source such that the pressure within the interior volume 111 of the container body 110 is reduced. The reduction of the pressure within the interior volume 111 can be such that container body 110 deforms. Similarly stated, the vacuum source can exert a suction force on the interior volume 111 thereby urging at least a portion of the container body 110 to deform under the vacuum force. Furthermore, the vacuum source can be configured to expose interior volume 111 to the suction force such that the interior volume 111 is substantially devoid of a gas (e.g., air). Said another way, the interior volume 111 is exposed to a negative pressure and thereby urges the container body 110 to substantially conform to a contour of the bulk material disposed therein.

In some embodiments, the flexible container 100 can collapse (e.g., conform to the bulk material) such that the bulk material disposed within the container body 110 can act as a substantially solid mass. For example, in some embodiments, the flexible container 100 can collapse such that a distance between adjacent parts of a bulk material is reduced. In this manner, the movement of specific parts (e.g., particles, pellets, grains, chunks, portions, and/or the like) of the bulk material is reduced relative to adjacent parts of the bulk material. Thus, the potential of load shifting within the flexible container 100 is reduced. In some embodiments, the substantial evacuation of the gas (e.g., air) within the flexible container 100 can reduce the risk of spontaneous combustion of the bulk material (e.g., coal).

In some embodiments, the flexible container 100 can be placed into and/or secured within a rigid shipping container. In such embodiments, the flexible container 100 can include a set of tethers (not shown in FIGS. 1-3) configured to couple the flexible container 100 to an inner surface of the rigid container. For example, in some embodiments, the tethers can include a first portion that can be coupled to the flexible container 100 and a second portion that can be coupled to the rigid container. In some embodiments, the tethers can be formed of a flexible material such that with the tether coupled to the flexible container 100 and the rigid container, a length of the tether can extend when the flexible container 100 is moved from the expanded configuration to the collapsed configuration. Similarly stated, the flexible container 100 can be disposed within the rigid container such that the flexible container 100 moves relative to the rigid container (e.g., away from a set of walls of the rigid container) thereby urging the length of the tethers to extend. In some embodiments, the flexible container 100 can further include a bumper portion configured to engage a surface of the rigid container and absorb a portion of a force from any load shifting within the rigid container. The bumper portions can be any suitable portion. For example, in some embodiments, the bumper portions include one or more sleeves configured to receive a shock absorbing member. In other embodiments, the bumper portions can be inflated with a gas (e.g., air). Similarly stated, in some embodiments, the flexible container 100 can include an integrated dunnage system to minimize the transfer of load to (or deformation of) the rigid container within which the flexible container 100 is disposed.

Figure 4:
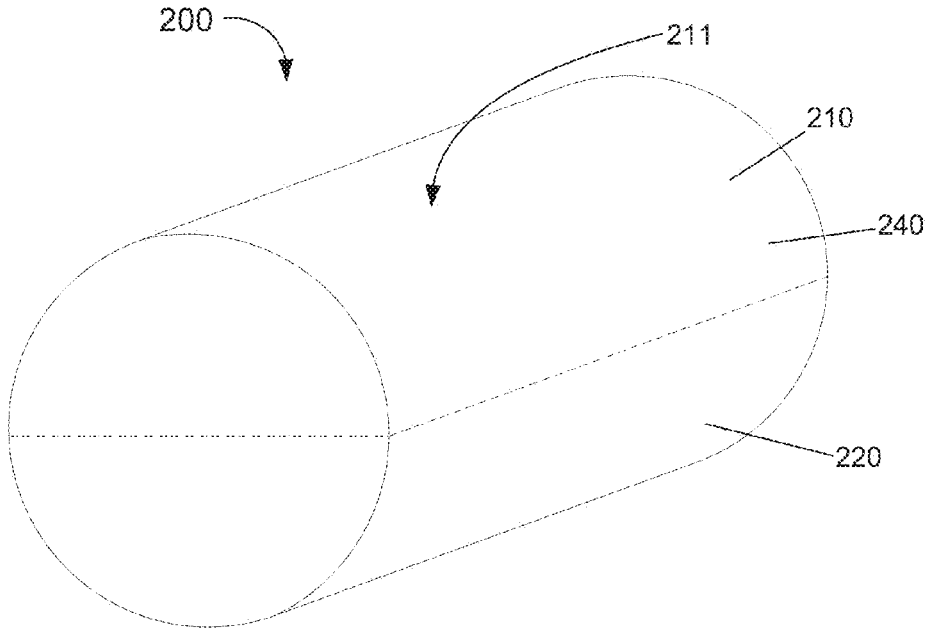
FIGS. 4 and 5 are schematic illustrations of a flexible container according to an embodiment, in first configuration and a second configuration, respectively.
Figure 5:
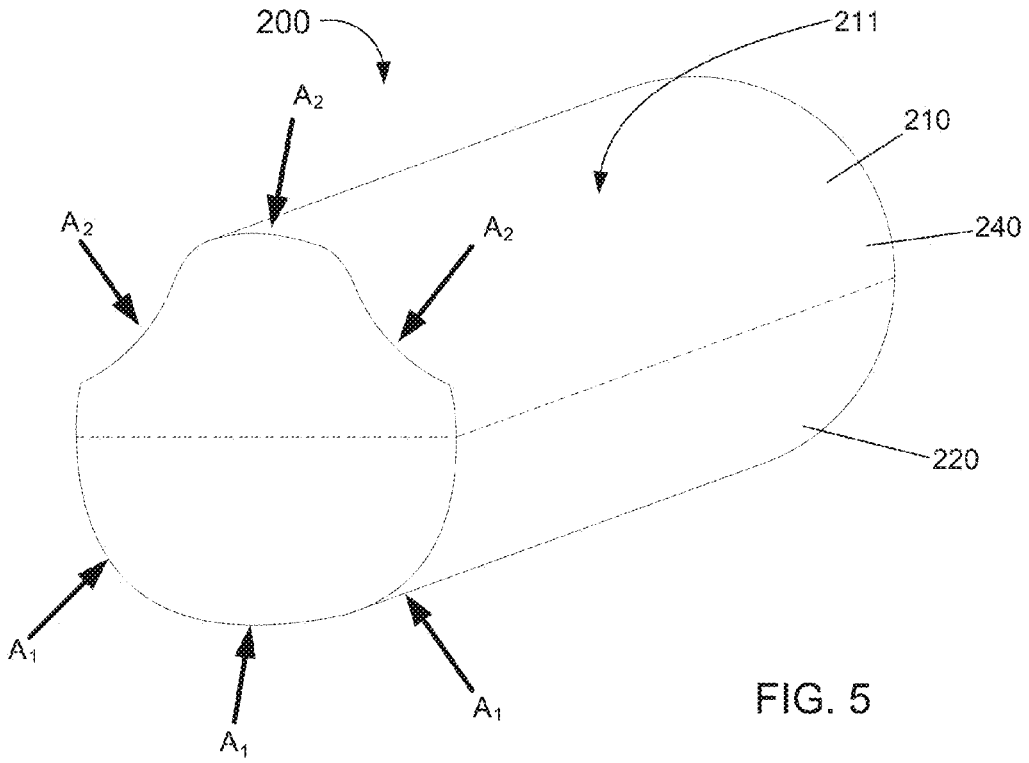

In some embodiments, a flexible container can include portions formed from different materials. In this manner, the rate of deformation of the flexible container when moved to the collapsed configuration can vary spatially. For example, FIGS. 4 and 5 show a flexible container 200 that includes a container body 210 and defines an interior volume 211 therein. The flexible container 200 is configured to move between an expanded configuration (e.g., FIG. 4) and a collapsed configuration (e.g., FIG. 5). Although the flexible container 200 is shown as defining a volume when in the collapsed configuration, in other embodiments, the flexible container 200 can be configured to be moved to a collapsed configuration in which the container defines substantially no volume therein (e.g., a container storage configuration). The flexible container 200 can be any suitable shape or size. For example, in some embodiments, the flexible container 200 can define a cylindrical shape. The flexible container 200 can be formed from any suitable material, such as any suitable materials of the type described herein or any combination thereof.

As shown in FIG. 4, the container body 210 includes a first portion 220 and a second portion 240. The first portion 220 and the second portion 240 can be formed from a similar or dissimilar material, and can be characterized by a similar or dissimilar stiffness and/or flexibility. The first portion 220 is formed from a first material that has a first stiffness and the second portion 240 is formed from a second material, different than the first material, that has a second stiffness, different from the first stiffness. In some embodiments, the first material of the first portion 220 is substantially stiffer than the second material of the second portion 240.

In some embodiments, the first portion 220 and the second portion 240 can be coupled together to form the container body 210. In such embodiments, the first portion 220 and the second portion 240 can be coupled in any suitable manner. For example, in some embodiments, the first portion 220 and the second portion 240 can be coupled via adhesive, chemical weld or bond, sewn, insertion into a flange or coupling device, and/or the like. In this manner, the first portion 220 and the second portion 240 define a substantially fluidic seal. Similarly stated, the first portion 220 is coupled to the second portion 240 to define a non-permeable coupling (e.g., air tight).

In some embodiments, the flexible container 200 includes multiple layers (not shown). For example, in some embodiments, the first portion 220 and the second portion 240 can each be constructed from multiple layers. In such embodiments, the multiple layers of the first portion 220 and/or the second portion 240 can be formed from any suitable material such as those described herein. Furthermore, the multiple layers of the first portion 220 and/or the second portion 240 can be formed from similar or dissimilar materials. For example, a first layer can be formed from a first material and a second layer can be formed from a second material. In some embodiments, one or more of the multiple layers included in the second portion 240 can be similar to one or more of the multiple layers of the first portion 220. The multiple layers of the first portion 220 and the multiple layers of the second portion 240 can be coupled together to define the fluidic seal (e.g., as described above).

When in the expanded configuration (e.g., FIG. 4), the flexible container 200 can receive a bulk material (not shown) such that the bulk material is disposed within the interior volume 211. With the desired amount of bulk material disposed within the interior volume 211, the flexible container 200 can be moved from the expanded configuration to the collapsed configuration, as shown in FIG. 5. More specifically, a pressure within the interior volume 211 can be reduced such that the flexible container 200 collapses in response to the reduced pressure. In some embodiments, the flexible container 200 can include a port (not shown in FIGS. 4 and 5) that can be engaged by, for example, a vacuum source configured to reduce the pressure within the interior volume 211 of the container body 210. Similarly stated, the vacuum source can exert a suction force on the interior volume 211 thereby urging at least a portion of the container body 210 to deform under the force. Furthermore, the vacuum source can be configured to expose the interior volume 211 to the suction force such that the interior volume 211 can be substantially evacuated (i.e., substantially devoid of a gas). Said another way, the interior volume 211 is exposed to a negative pressure and thereby urges the container body 210 to substantially conform to a contour of the bulk material disposed therein.

As described above, the first portion 220 can be formed from the first material and define the first stiffness and the second portion 240 can be formed from the second material and define the second stiffness. In this manner, with the suction force applied to the interior volume 211 of the container body 210, the first stiffness of the first portion 220 is such that the first portion 220 deforms a first amount, as shown by the arrows $A_1$ in FIG. 5. Similarly, the second stiffness of the second portion 240 is such that the second portion 240 deforms a second (different) amount, as shown by the arrows $A_2$ in FIG. 5. Furthermore, with the stiffness of the second portion 240 being substantially less than the first portion 220, the second portion 240 deflects (e.g., deform) substantially more than the first portion 220.

In some embodiments, the flexible container 200 can collapse (e.g., conform to the bulk material) such that the bulk material disposed within the container body 210 can act as a substantially solid mass. For example, in some embodiments, the flexible container 200 can collapse such that a distance between adjacent portions and/or components of the bulk material is reduced. In this manner, the movement of specific parts (e.g., particles, pellets, grains, chunks, portions, and/or the like) of the bulk material is reduced relative to adjacent parts of the bulk material. Similarly stated, when the flexible container 200 is moved from the expanded configuration to the collapsed configuration, the bulk material therein can be moved from a flowable (or partially flowable) state to a substantially non-flowable state. Thus, the potential of load shifting of the bulk material within the flexible container 200 is reduced. Accordingly, the flexible container 200 can be strapped and/or anchored to and/or within a shipping platform or container using tethers and/or straps. In some embodiments, for example, the flexible container 200 can be coupled within any of the rigid shipping containers described herein (e.g. the rigid shipping container 465) without the need for dunnage bags, bulkheads and/or bulwarks to absorb load from the shifting of the bulk material therein.

In some embodiments, the substantial evacuation of the gas (e.g., air) within the flexible container 200 can reduce the risk of spontaneous combustion of the bulk material (e.g., coal). In some embodiments (e.g., when the bulk material is a food product), the substantial evacuation of the gas (e.g., air) within the flexible container 200 can reduce the risk contamination, reaction and/or the like.

In some embodiments, the flexible container 200 can include one or more layers that are monolithically formed and are disposed within the first portion 220 and the second portion 240 to act as a liner (not shown in FIGS. 4 and 5). The inner layer (or liner) can be formed from any suitable material and can include any suitable material characteristic such as, for example, flexibility, durometer, compliance, abrasion resistance, and/or the like. For example, in some embodiments, the flexible container 200 can include the inner layer and the first portion 220 and the second portion 240. The first portion 220 and the second portion 240 can be coupled together such that the inner layer is disposed within the interior volume 211 defined by the first portion 220 and the second portion 240 of the container body 210. In some embodiments, the inner layer abrasion resistant and fluidically permeable. In this manner, the inner layer can protect the first portion 220 and the second portion 240 from sharp portions and/or points included in the bulk material. Moreover, when the flexible container 200 is moved to the collapsed configuration, the suction force (e.g., the vacuum) can pass through the inner layer and exert at least a portion of the suction force of the first portion 220 and the second portion 240. Therefore, the first portion 220 and the second portion 240 can collapse to place the flexible container 200 in the collapsed configuration.

While shown in FIGS. 1-3 as defining an irregular shape, in some embodiments a flexible container can define a substantially rectangular shape. For example, as shown in FIGS. 6-13, a flexible container 300 includes a container body 310, a side wall 312, a bulkhead 325, and a cover 360. The flexible container 300 can be any suitable size, for example, a size configured to fit within a commercially-available shipping container, or any of the rigid containers shown and described herein. For example, the flexible container 300 defines a length L, a height H, and a width W. In some embodiments, the length L can be approximately 20 feet, the height H can be approximately 8 feet, and the width can be approximately 7.5 feet. In other embodiments, the length L can be approximately 40 feet, the height can be approximately 8 feet, and the width can be approximately 7.5 feet.

The container body 310 includes a first portion 320 and a second portion 340 and defines an interior volume 311. The first portion 320 and the second portion 340 can be formed from any suitable material. In some embodiments, the first portion 320 and/or the second portion 340 can be formed from a similar or dissimilar material and can define a similar or dissimilar stiffness (e.g., flexibility). For example, the first portion 320 is formed from a first material that has a first stiffness, and the second portion 340 is formed from a second material, different than the first material, that has a second stiffness, different from the first stiffness. In some embodiments, at least a portion of the first portion 320 is formed from polyethylene woven fabric (e.g., 120 g/sqm) and at least a portion of the second portion 340 is formed from polyethylene film (e.g., 140 microns thick). Polyethylene is flexible, inert, and creates a lower static charge than, for example, polypropylene. Thus, polyethylene is a suitable material for the transportation of certain bulk materials such as, for example, coal. Furthermore, with the first portion 320 formed from polyethylene woven fabric, the first portion 320 is substantially stiffer than the second portion 340 formed from polyethylene film. As described herein, this arrangement can result in different rates of deformation when the container 300 is moved from an expanded configuration to a collapsed configuration.

Figure 6:
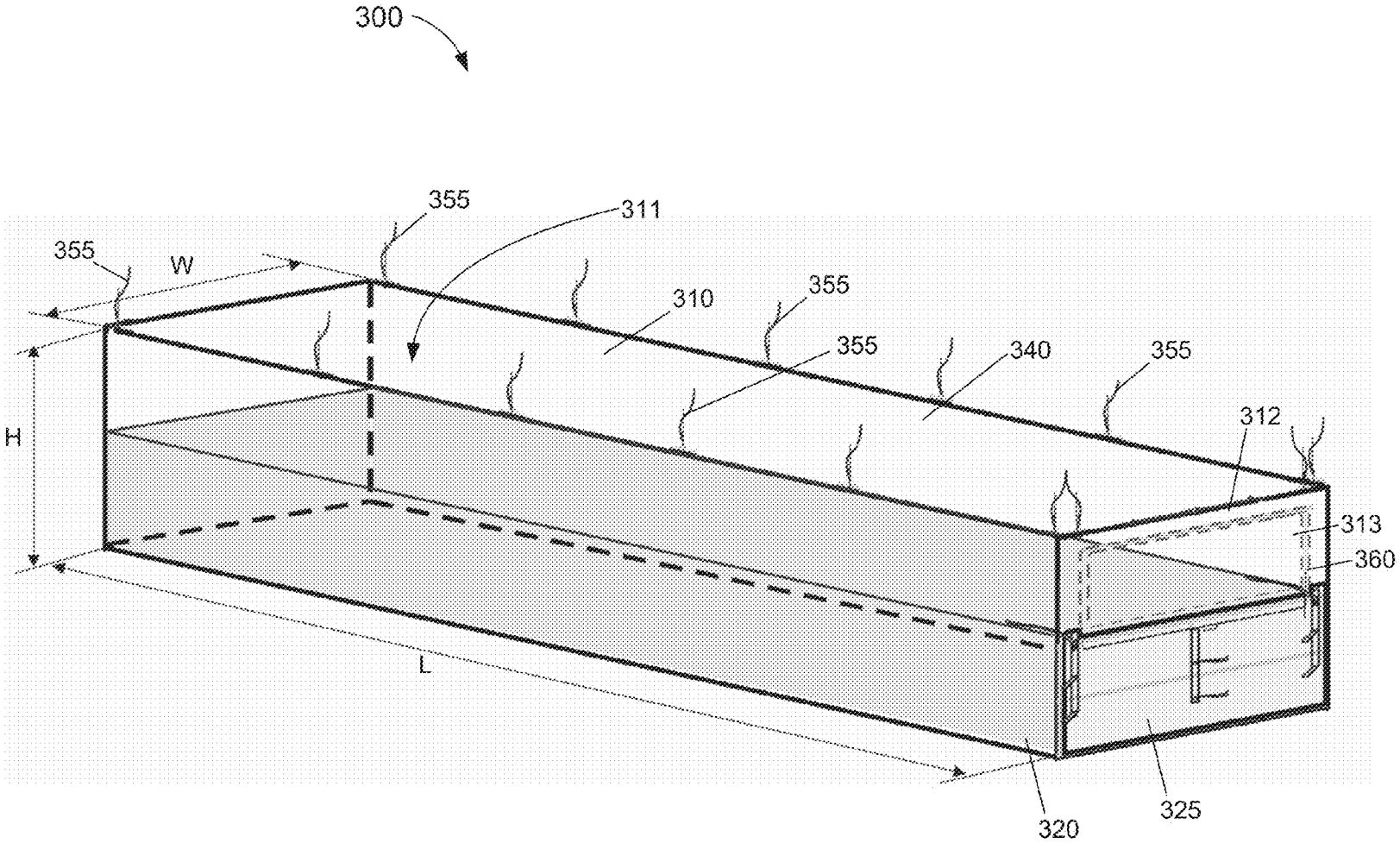
FIG. 6 is a perspective view of a flexible container, according to an embodiment.

As shown in FIG. 6, the first portion 320 and the second portion 340 are coupled together to form the container body 310. The first portion 320 and the second portion 340 can be coupled in any suitable manner. For example, in some embodiments, the first portion 320 and the second portion 340 can be coupled via adhesive, chemical weld or bond, sewn, insertion into a flange or coupling device, and/or the like. In this manner, the first portion 320 and the second portion 340 define a substantially fluidic seal. Similarly stated, the first portion 320 is coupled to the second portion 340 such as to define a non-permeable coupling (e.g., air tight). In other embodiments, the first portion 320 and the second portion 340 form a monolithically constructed container body 310.

The flexible container 300 includes multiple layers (not shown). In some embodiments, the first portion 320 and/or the second portion 340 include multiple layers. In some embodiments, the flexible container 300 can include one or more layers substantially independent of the first portion 320 and/or the second portion 340 (e.g., a liner). In such embodiments, the multiple layers of the first portion 320 can be formed from any suitable material such as those described above. Furthermore, the multiple layers of the first portion 320 can be formed from similar or dissimilar materials. For example, an inner layer can be formed from polyethylene woven fabric a first material and a second layer can be formed from a second material. Similarly, the multiple layers of the second portion 340 can be formed from any suitable material. In some embodiments, the multiple layers of the second portion 340 are formed from a similar or dissimilar material. In some embodiments, one or more of the multiple layers included in the second portion 340 can be similar to one or more of the multiple layers of the first portion 320. The multiple layers of the first portion 320 and the multiple layers of the second portion 340 can be coupled together to define the fluidic seal (e.g., as described above).

Figure 7:
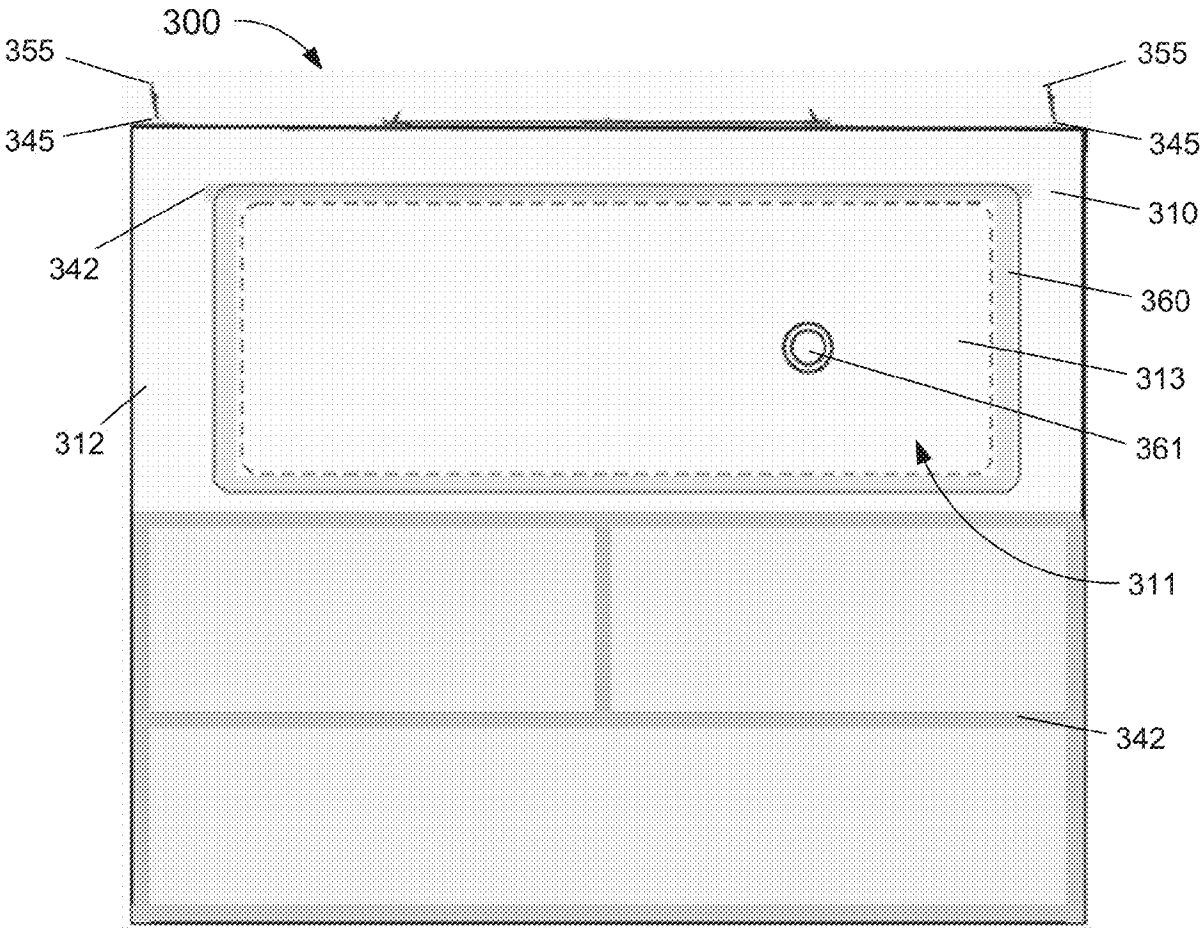
FIG. 7 is a front view of a portion of the flexible container of FIG. 6.

As shown in FIG. 7, the side wall 312 defines a substantially rectangular-shaped opening 313. The opening 313 can receive a portion of a delivery member (not shown) configured to convey a bulk material (not shown) to be disposed within the interior volume 311 defined by the container body 310. For example, in some embodiments, the delivery member can be a conveyer configured to transfer raw coal to the interior volume 311 via the opening 313. In other embodiments, the delivery mechanism can be a hose configured to be coupled to the side wall 312 such that the hose delivers processed coal to the interior volume 311 via the opening 313.

In some embodiments, the delivery mechanism is configured to telescope (i.e., change lengths) within the container body 311, as described above. For example, in some embodiments, a conveyer can be disposed through the opening 313 and within the interior volume 311 of the container body 313 such that the conveyer can transfer the bulk material to the interior volume 311 such that the container body 310 is loaded from back to front. Similarly stated, as the conveyer transfers the bulk material to the interior volume 311, the conveyer can be configured to retract with respect to the side wall 312. In this manner, the bulk material can be loaded with a suitable weight distribution thus reducing load shifting during transport. In some embodiments, the flexible container 300 can include an internal telescoping member (not shown) configured to selectively convey a bulk material from a delivery member (e.g., distribute the bulk material within the interior volume).

The cover 360 includes a port 361 and is configured to be coupled to the side wall 312 about the opening 313. More particularly, the cover 360 is coupled to the side wall 312 and about the opening 313 such that the cover 360 fluidically isolated the interior volume 311 from a volume substantially outside the container body 310. Similarly stated, the cover 360 is configured to fluidically seal the container body 310. The cover 360 can be formed from any suitable material, such as a similar material as at least a portion of the container body 310. For example, in some embodiments, the cover 360 is formed from polyethylene film with a 140 micron thickness. In other embodiments, the cover 360 can be any suitable thickness.

The cover 360 can be coupled to the side wall 312 in any suitable manner. For example, as shown in FIG. 7, cover 360 is coupled to the side wall 312 via an adhesive strip 342. The adhesive strip 342 can be any suitable adhesive such as, for example, a glass fiber glue tape. In this manner, the cover 360 and the side wall 312 can define a substantially planar surface when the flexible container 300 is in the expanded configuration. Similarly stated, the cover 360 is configured to engage a substantially flat surface of the side wall 312 such that the cover 360 and the side wall 312 are substantially co-planar. Said another way, the cover 360 couples to a portion of the side wall 312 defining the opening 313 that is substantially flat (e.g., does not include a mounting flange, ring, protrusion, and/or the like). The use of the adhesive strip 342 is such that when the cover 360 is coupled to the side wall 312 the cover 360 fluidically isolates the interior volume 311 defined by the container body 310. In other embodiments, the cover 360 can be coupled to the side wall 312 using any suitable method, such as, for example, a chemical weld.

Figure 8:
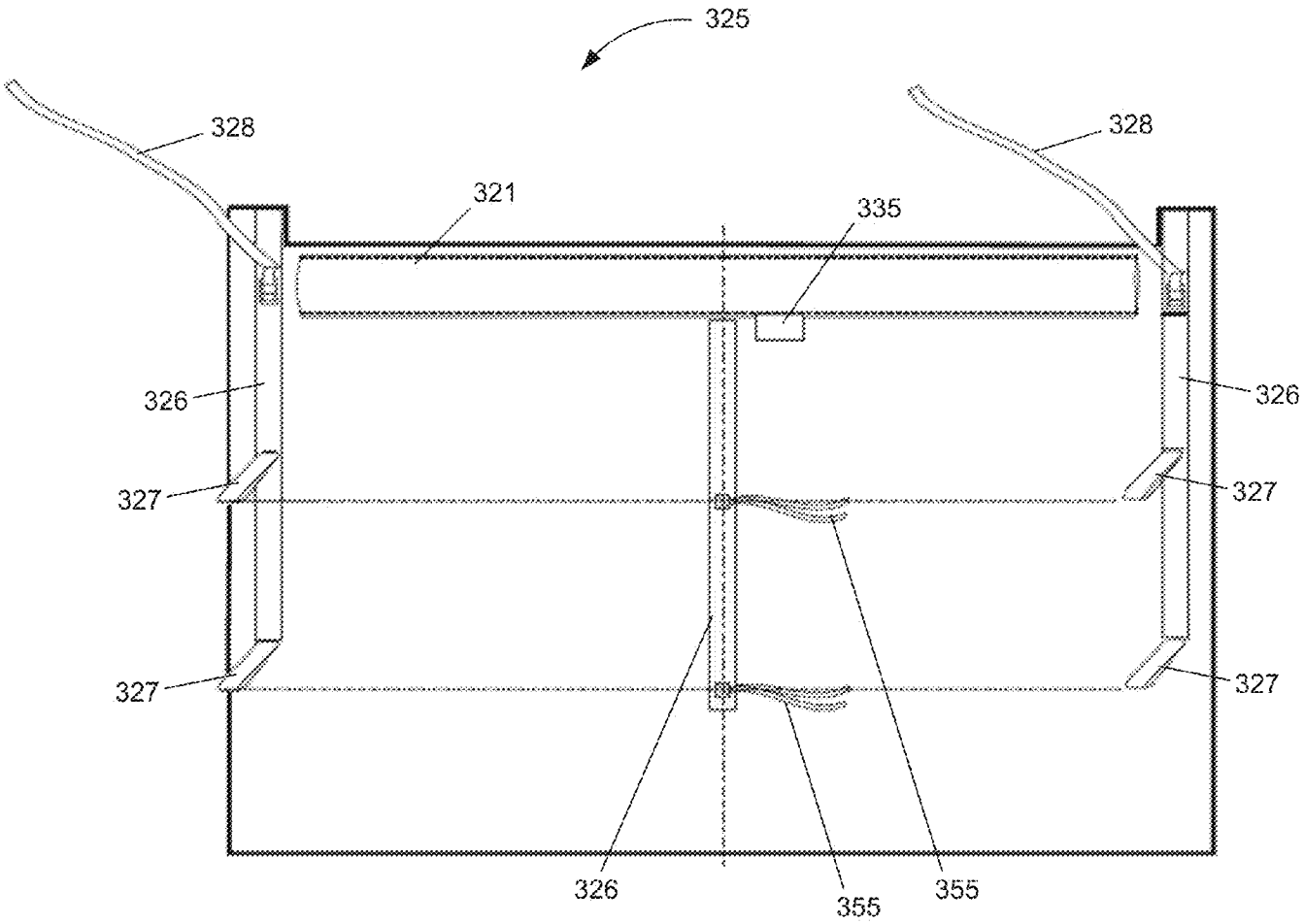
FIG. 8 is a front view of a bulkhead included in the flexible container of FIG. 6.

The side wall 312 further includes a portion configured to which the bulkhead 325 is coupled (see e.g., FIG. 8). The bulkhead 325 is configured to provide mechanisms for absorbing load, handling and/or manipulating the container 300. The bulkhead 325 can be any suitable shape, size, or configuration. For example, the bulkhead 325 is substantially similar in height and width as the first portion 320 of the container body 310. In this manner, when coupled to the side wall 312 the bulkhead 325 transfers a portion of a force (e.g., a load shift during transport) to the relatively stiff first portion 320 and not the relatively flexible second portion 340. The bulkhead 325 can be formed from any suitable material that includes any suitable weight. For example, in some embodiments, the bulkhead 325 is formed from polypropylene woven fabric with a weight of 210 g/sqm. In this manner, the use of polypropylene woven fabric is such that the bulkhead is substantially stiffer than the first portion 320 and/or the second portion 340. Thus, in use the bulkhead 325 is less likely to deform when the flexible container 300 is placed in the collapsed configuration.

Figure 9:
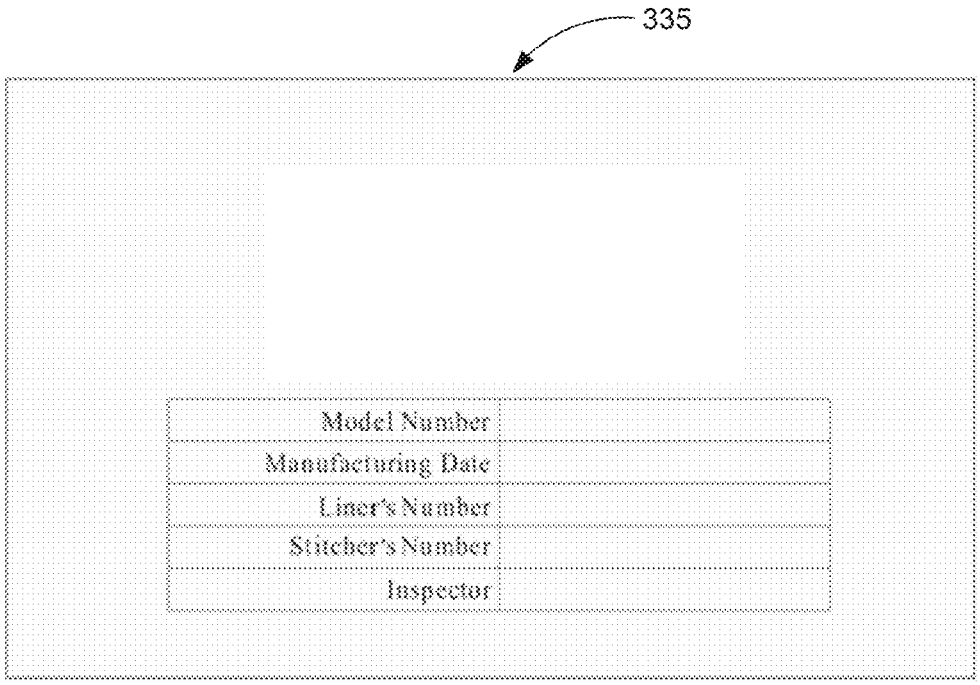
FIG. 9 is an illustration of a label included in the bulkhead of FIG. 8.

The bulkhead 325 includes a sleeve 321, a set of webbing strips 326, and a material label 335. As shown in FIG. 9, the material label 335 can include information associated with the flexible container 300. The sleeve 321 is configured to extend from a surface of the bulkhead 325 to define a void. In some embodiments, the sleeve 321 can be coupled to the bulkhead 325 in any suitable manner such as, for example, those described above. In other embodiments, the sleeve 321 can be monolithically formed with the bulkhead 325. The sleeve 321 is configured to receive a shock absorbing member (not shown) within the void defined between the sleeve 321 and the bulkhead 325, as described in further detail herein. The webbing strips 326 can be coupled to the bulkhead 325 in any suitable manner. For example, in some embodiments, the webbing strips 326 can be sewn to the bulkhead 325. In other embodiments, the webbing strips 326 can be chemically welded and/or coupled via adhesives. The webbing strips 326 include a set of loops 327, a set of ratchet straps 328, and a set of tethers 355. In use, the flexible container 300 is configured to be disposed within a rigid container (not shown) and the loops 327, the ratchet straps 328, and/or the tethers 355 can engage an interior portion of the rigid container to couple the flexible container 300 to the interior portion of the rigid container.

Figure 10:
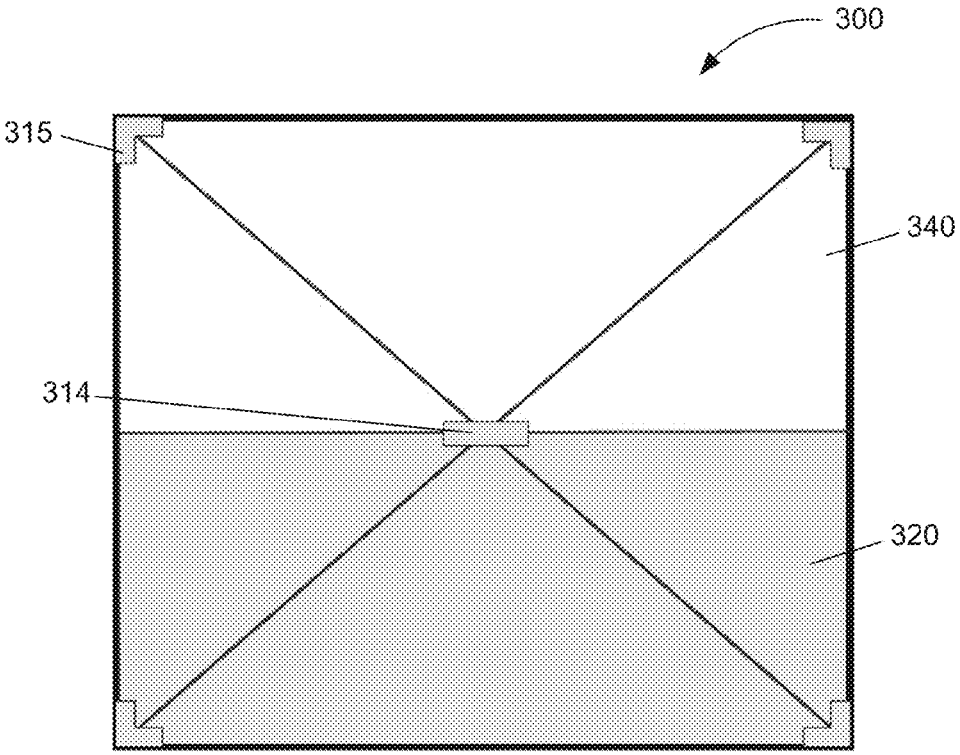
FIG. 10 is a rear view of the flexible container of FIG. 6.

Similarly, the second portion 320 and a rear portion of the flexible container 300 can include members configured to engage the interior portion of the rigid container. For example, as shown in FIG. 10, the rear portion can include an elastic band 314 configured to engage the interior portion of the rigid container. The rear portion can further include corner caps 315 configured to protect the corners of the flexible container 300. In some embodiments, the corner caps 315 can include tethers and/or straps configured to engage the rigid container.

Figure 11:
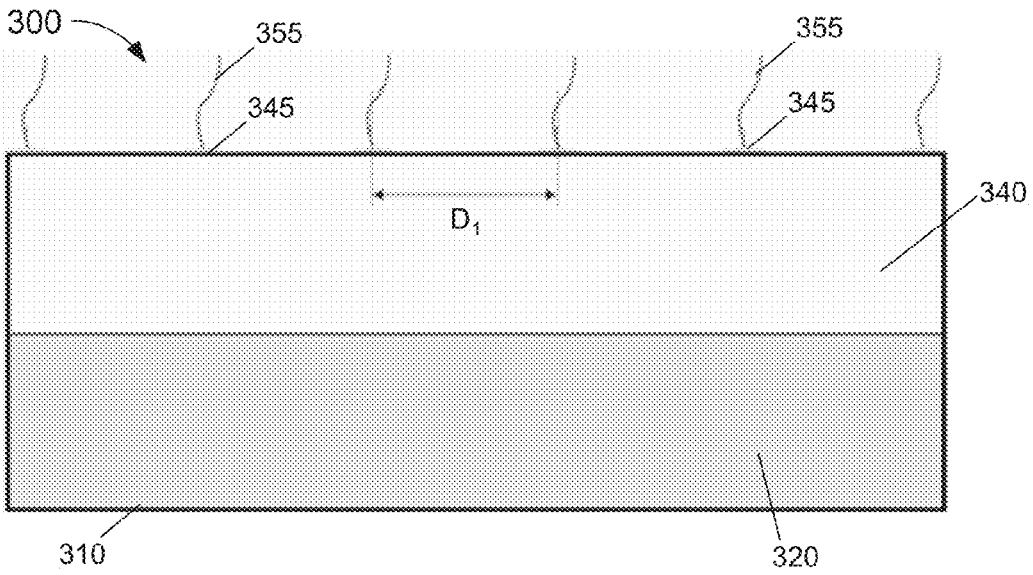
FIG. 11 is a side view of the flexible container of FIG. 6.
Figure 12:
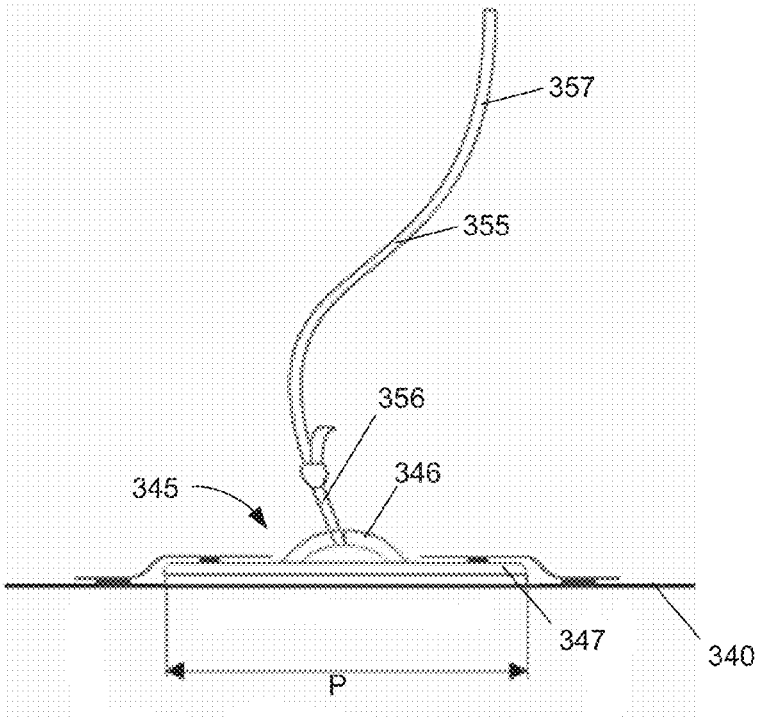
FIG. 12 is a front view of a portion of the flexible container of FIG. 6.

As shown in FIGS. 11 and 12, the second portion 340 includes a set of attachment members 345 configured to receive a portion of the tethers 355. The attachment members can be disposed on or within the second portion 340 at any suitable position. For example, in some embodiments, the attachment members 345 can be disposed along a top surface of the second portion 340 at a distance $D_1$ from adjacent attachment members 345. While shown in FIG. 11 as being substantially uniformly spaced, in some embodiments, the attachment members 345 can be spaced at any given distance from adjacent attachment members 345.

As shown in FIG. 12, the attachment members 345 include a loop portion 346 and a base 347. The base 347 is coupled to the second portion 340 of the container body 310. For example, in some embodiments, the base 347 is coupled to the second portion 340 via adhesive strips. In some embodiments, the second portion 340 defines a channel configured to receive the base 347 of the attachment member 345. The loop portion 346 is configured to receive a portion of the tether 355. More specifically, the tether 355 includes a first portion 356 configured to couple to the loop portion 346 and a second portion 357 configured to couple to the rigid container.

In use, the flexible container 300 is coupled to the rigid container (e.g., any of the rigid containers shown herein) and receives the bulk material via the opening 313. In some embodiments, when the bulk material is being conveyed into the interior volume 311, the container body 310 can be maintained in an expanded (or partially expanded) configuration by conveying an inflation fluid (e.g., air, nitrogen or any other suitable gas) into the interior volume 311. The inflation fluid can be conveyed into the interior volume 311 via the opening 313. Similarly stated the inflation fluid can be conveyed into the interior volume 311 via the same opening through which the bulk material is conveyed. This arrangement eliminates the need for multiple openings within the container body 310. Additionally, this mechanism for loading the container body 310 does not require a fluid-tight coupling between the delivery member and the container body 310. In other embodiments, the container body 310 can be maintained in the expanded (or partially expanded) configuration by any suitable mechanism, such as by attaching the corners of the container body 310 to a rigid structure via the tethers 355.

With the desired amount received within the internal volume, the cover 360 is coupled to the side wall 312 and the flexible container 300 is then moved to the collapsed configuration. Expanding further, the port 361 included in the cover 360 can be configured to act as an ingress or egress for a gas to be disposed within or expelled from the interior volume 311. For example, the port 361 can be engaged by a vacuum source such that the pressure within the interior volume 311 of the container body 310 is reduced. The reduction of the pressure within the interior volume 311 can be such that all or portions of the container body 310 deform. Similarly stated, the vacuum source can exert a suction force on the interior volume 311 thereby urging at least a portion of the container body 310 to deform under the force. Furthermore, the vacuum source can be configured to expose interior volume 311 to the suction force such that the interior volume 311 is substantially devoid of a gas (e.g., air). Said another way, the interior volume 311 is exposed to a negative pressure and thereby urges the container body 310 to substantially conform to a contour of the bulk material disposed therein.

As described above, the first portion 320 can be formed from the first material (e.g., polyethylene woven fabric) and define the first stiffness and the second portion 340 can be formed from the second material (e.g., polyethylene film) and define the second stiffness. In this manner, with the suction force applied to the interior volume 311 of the container body 310, the first stiffness of the first portion 320 is such that the first portion 320 deforms a first amount. Similarly, the second stiffness of the second portion 340 is such that the second portion 340 deforms a second amount. Furthermore, with the stiffness of the second portion 340 being substantially less than the first portion 320, the second portion 340 deflects (e.g., deform) substantially more than the first portion 320.

The tethers 355 (FIGS. 11 and 12) are formed from an elastomeric material such that with the tethers coupled 355 to the flexible container 300 and a rigid container, a length of the tether 355 extends when the flexible container 300 is moved from the expanded configuration to the collapsed configuration. This arrangement allows the flexible container 300 to be disposed and/or coupled within a rigid container such that the flexible container 300 moves relative to the rigid container (e.g., away from a set of walls of the rigid container) thereby urging the length of the tethers 355 to extend when the flexible container 300 is moved from the expanded configuration to the collapsed configuration.

Figure 13:
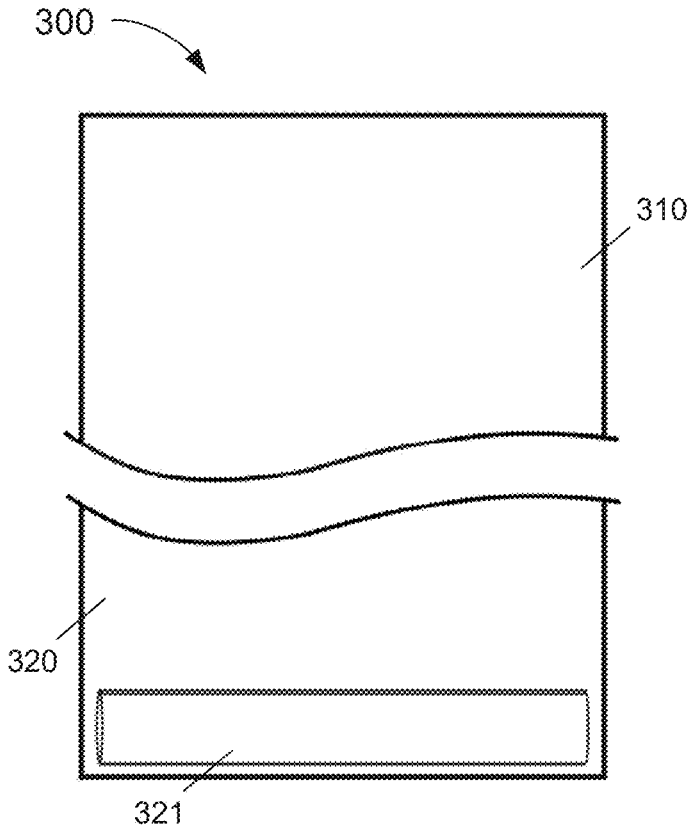
FIG. 13 is a bottom view of the flexible container of FIG. 6.

In some embodiments, the flexible container 300 can collapse (e.g., conform to the bulk material) such that the bulk material disposed within the container body 310 can act as a substantially solid mass. For example, in some embodiments, the flexible container 300 can collapse such that a distance between adjacent portions and/or components of the bulk material is reduced. In this manner, the movement of specific parts (e.g., particles, pellets, grains, chunks, portions, and/or the like) of the bulk material is reduced relative to adjacent parts of the bulk material. Similarly stated, when the flexible container 300 is moved from the expanded configuration to the collapsed configuration, the bulk material therein can be moved from a flowable (or partially flowable) state to a substantially non-flowable state. Thus, the potential of load shifting of the bulk material within the flexible container 300 is reduced and/or eliminated. Accordingly, the flexible container 300 can be strapped and/or anchored within a shipping container using tethers and/or straps. Furthermore, as described above with reference to FIG. 8, the bulkhead 325 includes the sleeve 321 and the shock absorbing member. In this manner the sleeve 321 and the shock absorbing member (e.g., a steel member, series of members or bumper) can be configured to absorb a portion of a force (e.g., load shifting of the substantially solid mass within the rigid container) to reduce damage done to the rigid container, the flexible container 300 and/or the bulk material. Similarly, as shown in FIG. 13, a bottom surface of the flexible container 300 includes a sleeve 321. Furthermore, while shown in FIGS. 8 and 13 as being disposed in specific locations, in some embodiments, a flexible container can include any number of sleeves 321 that can be disposed at any suitable location on or about the flexible container.

Any of the flexible containers described herein can be disposed and/or coupled within a commercially-available, rigid shipping container. In this manner, processed or raw coal or other granular or powdered material may be transported in a sealed container of a size and weight that is within the capabilities of existing shipping and transfer equipment utilized in connection with containerized transport. Currently, this is in the range of 25-30 tons per one twenty-foot equivalent (TEU) container, which measures 20 feet by 10 feet by 8 feet, and approximately the same tonnage per two TEU containers, which measures 40 feet by 10 feet by 8 feet. Using containerized transport, a 5,000 TEU vessel can transport 100,000 tons of raw coal per voyage, which is substantially larger than the amount of raw coal per voyage that can be transported using the Handy or Panamax class. If greater quantities are desired, a 10,000 TEU vessel can be utilized, which can transport approximately 240,000 tons of coal, or a 15,000 TEU vessel can be used to transport in excess of 300,000 tons of coal.

The most common sizes for rigid shipping containers are 20 feet or 40 feet in length. In some embodiments, for example, in use with a flexible container, a 20-foot container can have the capacity of holding approximately 25-30 tons of raw granular coal or powdered coal. In some embodiments, to accommodate larger quantities of processed materials (such as 40-45 tons of pulverized material) a rigid container can be reinforced and/or specially designed to maximize the efficiency of transporting coal.

Figure 14:
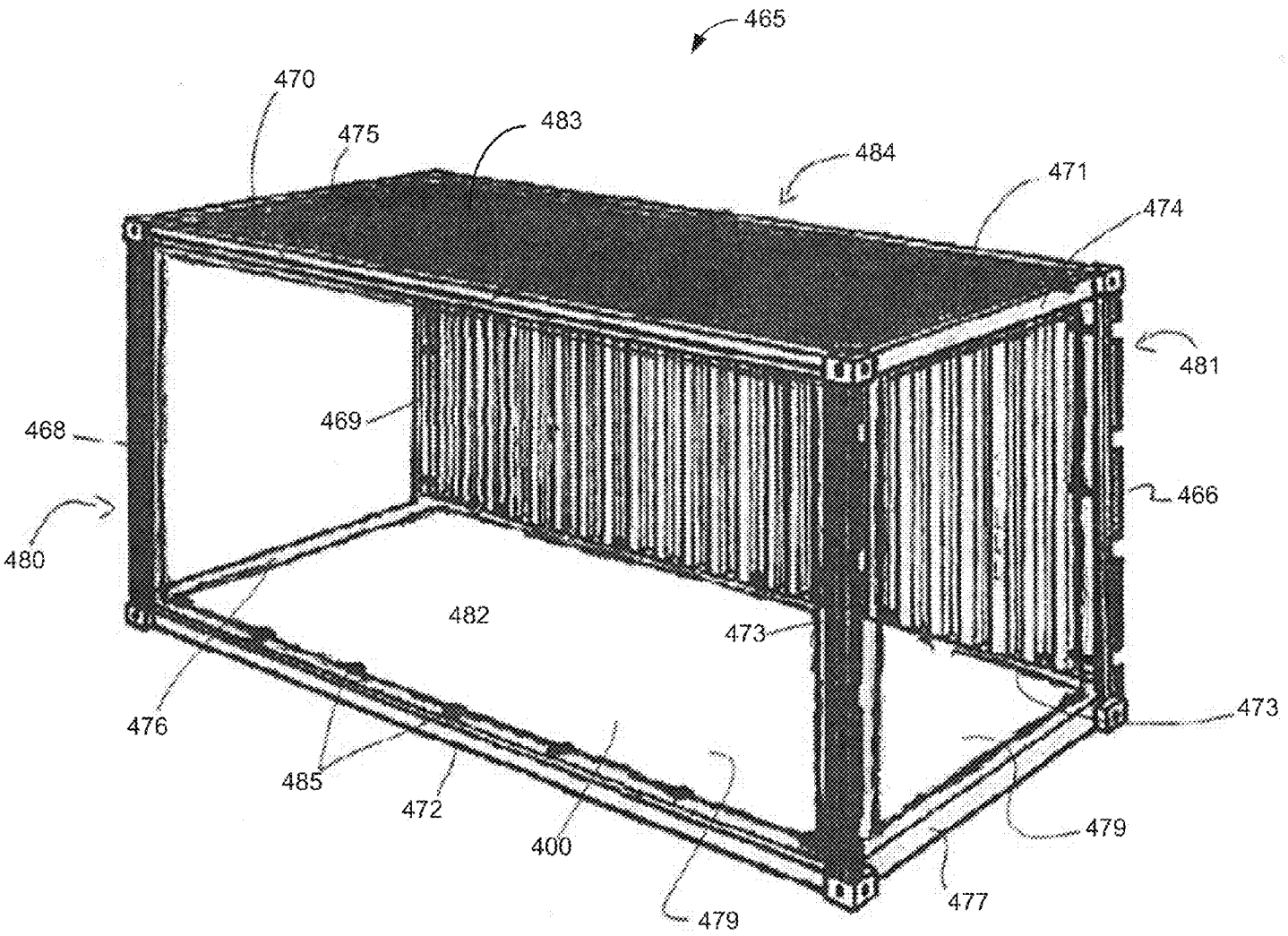
FIG. 14 is a perspective view of a container, according to an embodiment.

As shown in FIG. 14, a typical rigid container 465 includes four corner posts 466, 467, 468, 469. The rigid container 465 also includes long rails 470, 471, 472, 473 along of the top and bottom of the rigid container 465, which are connected to the corner posts. The rigid container 465 also includes short rails 474, 475, 476, 477 along the top and bottom of the rigid container 465, which are also connected to the corner posts 466, 467, 468, 469. The corner posts, long rails and short rails provide structural support for the rigid container 465, and enable it to be secured to a crane, or a truck or rail car. The rigid container 465 also includes side panels 478, 479, 480, 481, bottom panel 482 and top panel 483, which are secured to the corner posts, long rails and short rails. In some embodiments, for example as seen in FIG. 14, the rigid container 465 includes a hinged or sliding door 484 in the top panel 483. The door permits loading and unloading of the material to be transported.

Figure 15:
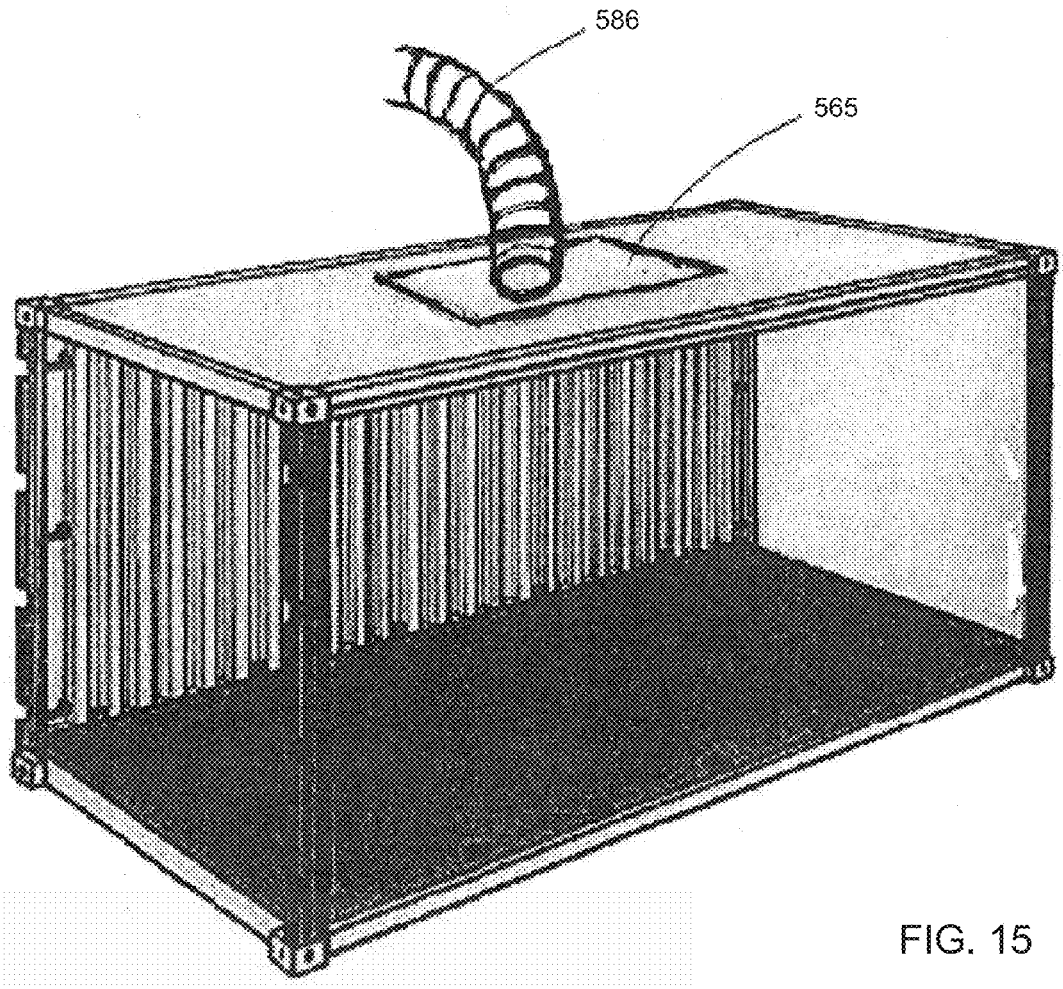
FIG. 15 is a top perspective view of a container, according to an embodiment.

After processing, the granulated or powdered coal is loaded into the rigid container 465. In some embodiments, system can include a flexible container (such as the flexible container 300) disposed within the rigid container 465, and the coal can be loaded in via a front opening (e.g., opening 313), as described above. The coal can be loaded into the rigid container 465 and/or a flexible container therein with a conventional-type conveyor loading system, or feeding through an enclosed piping system, such as a forced-air fluid bed system or a screw-based system. In other embodiments, the coal can be loaded into the rigid container 465 and/or a flexible container by conventional mechanical means, such as via a construction payloader. In yet other embodiments, the coal can be loaded into the rigid container 465 and/or a flexible container by an air-driven system. As shown in FIG. 15, in some embodiments, a rigid container 565 can include a flexible pipe 586 coupled thereto to facilitate a method using an air driven system.

During loading, the rigid container 465 may also be positioned above the ground, at ground level or below ground. It could also be positioned on an automated track system such that multiple rigid containers can be filled in a continuous manner. Filling can be completed until the rigid container 465 capacity is reached, as determined by volume or by weight. In other embodiments, as described herein, the rigid container 465 and/or the flexible container therein (e.g., flexible container 300) can be filled to a capacity that is less than the interior volume when the flexible container is in the expanded configuration.

As shown in FIG. 14, in one embodiment, coal is loaded through a sealable opening in the top of the rigid container. This can include one or more chutes positioned to receive the bulk material (e.g., raw coal and/or pulverized coal). The hinged or sliding door 484, or another type of portal, on the top of the rigid container 465 permits access to interior for loading. In such embodiments, a system can also include a flexible container, similar to the flexible container 300, having an opening in the top portion, rather than in the front portion (as shown in FIGS. 6 and 7). In the alternative, the entire top wall, or a portion of the top wall 483 of the rigid container 465 could be hinged to a side of the rigid container 465. Likewise, loading may be accomplished through a sliding or hinged door 484, or another portal, positioned in the side of the rigid container 465. An entire side-wall, or a portion of a side-wall, could also be hinged to another side-wall, or to the remaining portion of the side-wall that provides access. After the coal is loaded, the rigid container may be closed, locked and sealed from the outside air.

The rigid container 465 design can be such that the interior can be sealed from outside air after the powder or granulated material is loaded therein. This may be accomplished by use of a permanent or extractable flexible container, such as the flexible container 300, a permanent or extractable hard liner, a single use throwaway recyclable liner or a purpose-built rigid container.

The liner and/or flexible container, whether permanent or single use, extractable, flexible or hard, can be manufactured of a puncture resistant, sealable material that does not interact chemically with the processed coal. The liner and/or flexible container disposed and/or coupled within the rigid container 465 can be constructed from any of the materials described herein. An extractable liner will enable reuse of general purpose shipping rigid containers in the transport of other products (avoiding rigid container dead-heading). If the material is durable enough, an extractable liner would also permit efficient reuse of the liner for additional coal transport.

In some embodiments, a system can include a flexible container, of the types shown and described herein, disposed within a rigid container. For example, a flexible polymer-based bag with a thickness in the range of 0.5 inches to 0.75 inches would be well-suited for use in lining the rigid containers. The bag (or flexible container, such as the container 300) can be made of a non-reactive material, such as plastic, vinyl or silicon. The bag (or flexible container, such as the container 300) could also be made of an environmentally friendly material, or any material that is non-reactive, can be sealed, and will maintain a vacuum. The purpose of the liner is to aid sealing the contents of the rigid container, and to permit the rigid container to be reused for shipping of other goods after the coal is removed.

As shown in FIG. 14, the system includes a flexible container 400 disposed within the rigid container 465. The flexible container 400, which can be similar to the flexible container 300, may be temporarily held in position within the rigid container 465 prior to filing through the use of hook and loop fasteners 485 positioned along the edges and corners of the interior of the rigid container and the exterior of the liner. In some embodiments, the weight of the rigid container coal acts as a pressure seal when the bottom of the bag employs a flap for evacuating the coal.

As an alternative to a reusable flexible bag, in some embodiments, a liner may include a single-use sealable bag that may be discarded after use and recycled.

As an alternative to a flexible container, liner or bag, the rigid container can be lined with a non-reactive coating, such as a ceramic material. The coating might be permanent, in which case it could be cleaned after use, such that the rigid container can be re-used for shipment of other goods and services. In the alternative, the coating might be applied to a temporary sheath that could be removed from the rigid container and reused, permitting the rigid container to be used for other purposes.

Another approach is to have collapsible boxes (box within a box), with sealed hinges allowing for size to be minimized. The hinged box would be inserted into the outer rigid container by means of a sliding track or other method. The walls would be opened from their collapsed state and locked, creating a sealable box. Another alternative approach would be a purpose built rigid container, with the interiors being ceramic or polymer coated. Such coatings would permit efficient cleaning after coal transport. A purpose-built rigid container could also be designed so that it is collapsible in order to minimize cost of transport back to its point of origin.

Figure 18:
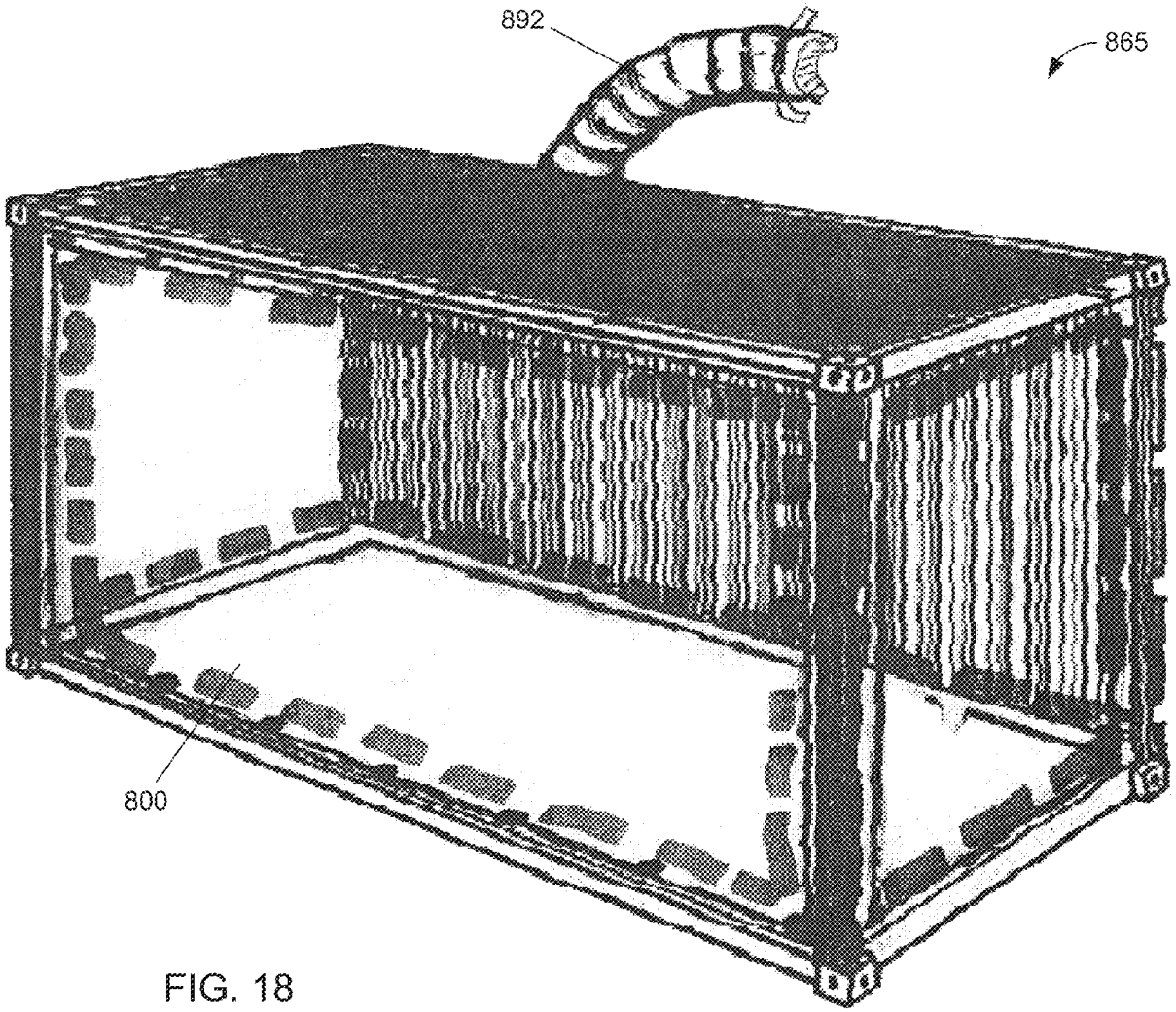
FIG. 18 is a perspective view of a container, according to an embodiment.
Figure 19:
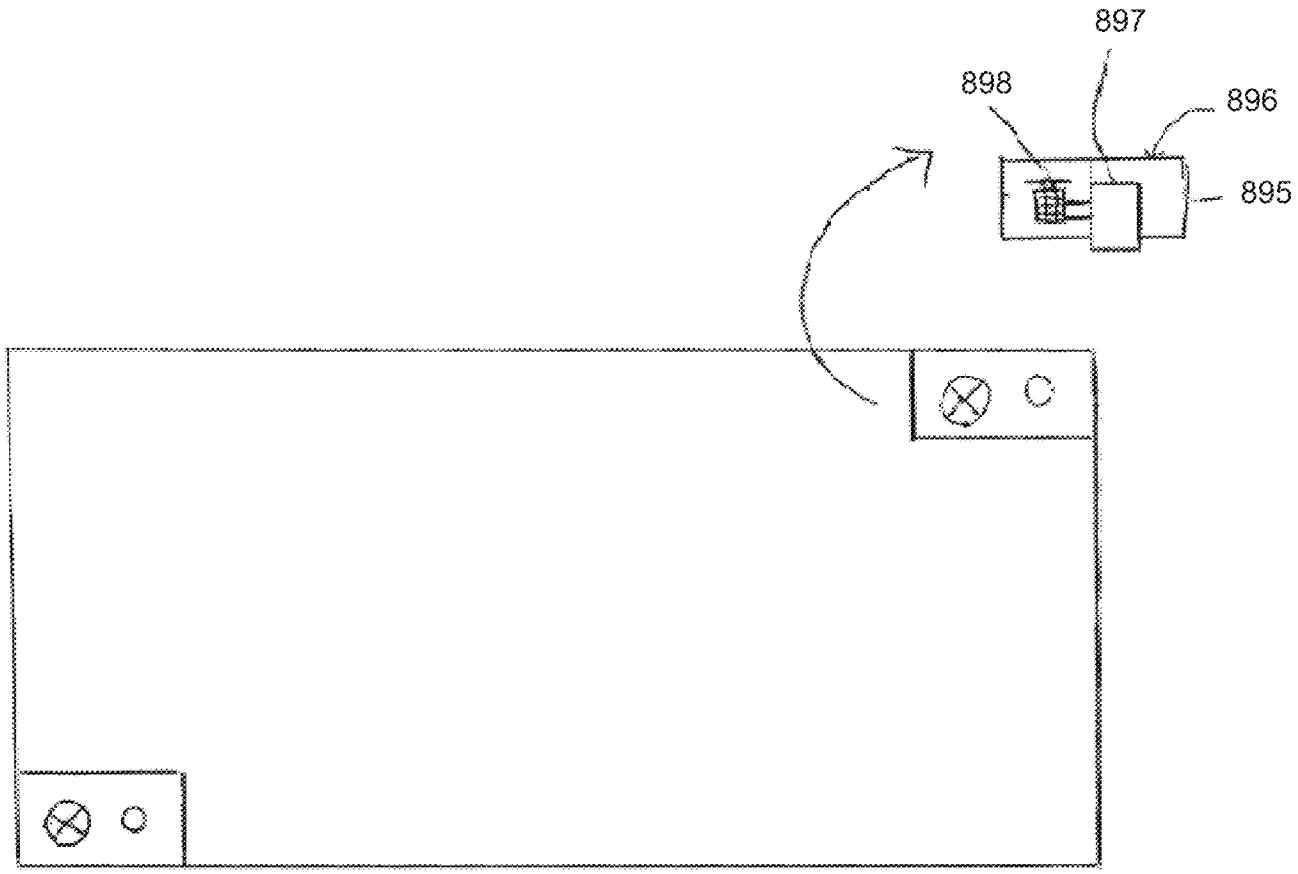
FIG. 19 is a schematic illustration of a valve assembly included in a flexible container, according to an embodiment.

Once sealed, air can be removed from the rigid container to reduce the risk of combustion, to minimize shifting of the bulk material therein or the like. For example as shown in FIGS. 18 and 19 a rigid container 865 can include a flexible container 800, a hose assembly 892, and a valve assembly 895. In some embodiments, air can be removed from the flexible container 800 with the valve assembly 895 positioned through one or more of the side-walls or the top of the rigid container. The valve assembly 895 can be positioned inside the rigid container such that the port is flush with the surface of the rigid container 896, so that it is not damaged during loading, transport or unloading of the rigid container. The valve assembly can include a portal 897 that can be attached to a negative pressure (vacuum) source, and a valve mechanism 898 for opening and sealing the portal. Suitable value mechanisms can include a ball valve, a butterfly valve, a gate valve or a globe valve. Alternative valve mechanisms, including mechanisms that are automatically actuated when a suitable negative pressure is achieved, may be utilized. The valve mechanism may also include a screen or filtration mechanism to prevent the rigid container contents from being drawn into the vacuum system. The vacuum could also be applied through multiple openings and seal assemblies on the upper and lower surfaces of the rigid container, or through the flexible pipe 586 (see e.g., FIG. 15) that is used to fill the rigid container. In some embodiments, the valve assembly 895 can be fluidically coupled to the vacuum port (e.g., port 361) of a flexible container (e.g., container 300) disposed within the rigid container.

Although shown as being coupled to the hose assembly 892, in other embodiments, the valve assembly 895 or any other suitable valve for the ingress (e.g., of the bulk material) and/or egress (e.g., of air) can be coupled directly to the flexible container. For example, in some embodiments, any suitable valve can be chemically welded to a side wall of a flexible container.

Regardless of the means for applying a vacuum, there can be corresponding openings in the liner or coating. With a permanent coating, this could be accomplished by sealing the coating around the vacuum port. With a flexible or hard liner, a portion of the liner could be fitted around the portal in a configuration that seals the liner to the surface adjacent the portal, such that when loaded with coal, air cannot leak into the liner. The liner could also include a region that is permeable to gasses but not solid materials, such that air can be withdrawn without coal powder and other solid materials being removed from the rigid container. After the vacuum is applied, to the portal, the portal opening is sealed to maintain negative pressure.

Vacuum sealing will minimize loss of volatiles from the coal. Further, the absence of oxygen will inhibit the combustibility of the processed coal inside the rigid container. A vacuum pump system would be present at loading and unloading sites. In one embodiment, a mobile vacuum pump can be utilized to extract the air from rigid containers are they are filled in an automated process. In the alternative, the mobile vacuum pump can be equipped to seal multiple rigid containers at the same time.

If further protection from combustion is required, an inert or non-combustible gas or mixture of gases may be injected into the rigid container after it is filled with coal. The gas can be injected into the rigid container through the vacuum port, or through a second port specifically designed for injection of the gas.

Preferred gases include helium, neon, argon, krypton, xenon, and radon. Other gases and mixtures of gases can be used, as long as they displace oxygen and provide a means of controlling the combustibility of the material in the rigid container. For example, nitrogen or carbon dioxide could be used when transporting coal.

Figure 16:
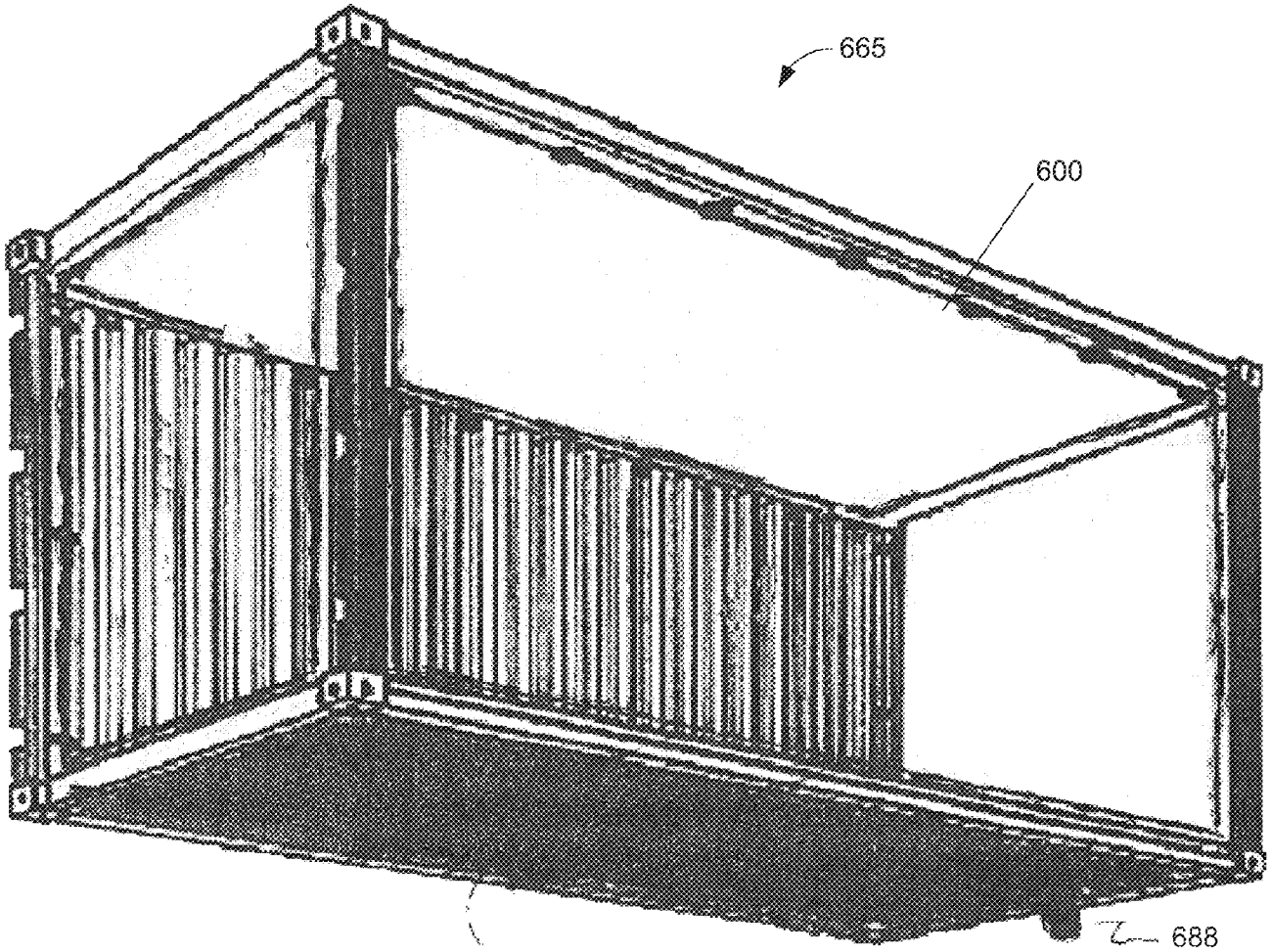
FIG. 16 is a bottom perspective view of a container, according to an embodiment.

For unloading, the rigid container may include an outlet port that can be attached to a hose and vacuum system at the end user location. In another embodiment, the rigid container can include a hinged or sliding door on the bottom panel as depicted in FIG. 16. In this configuration, the bottom door 687 is designed to withstand the weight of coal in the loaded rigid container. It is also designed to be opened via a handle or latch 688 positioned along a side wall at the bottom of the rigid container.

Figure 20:
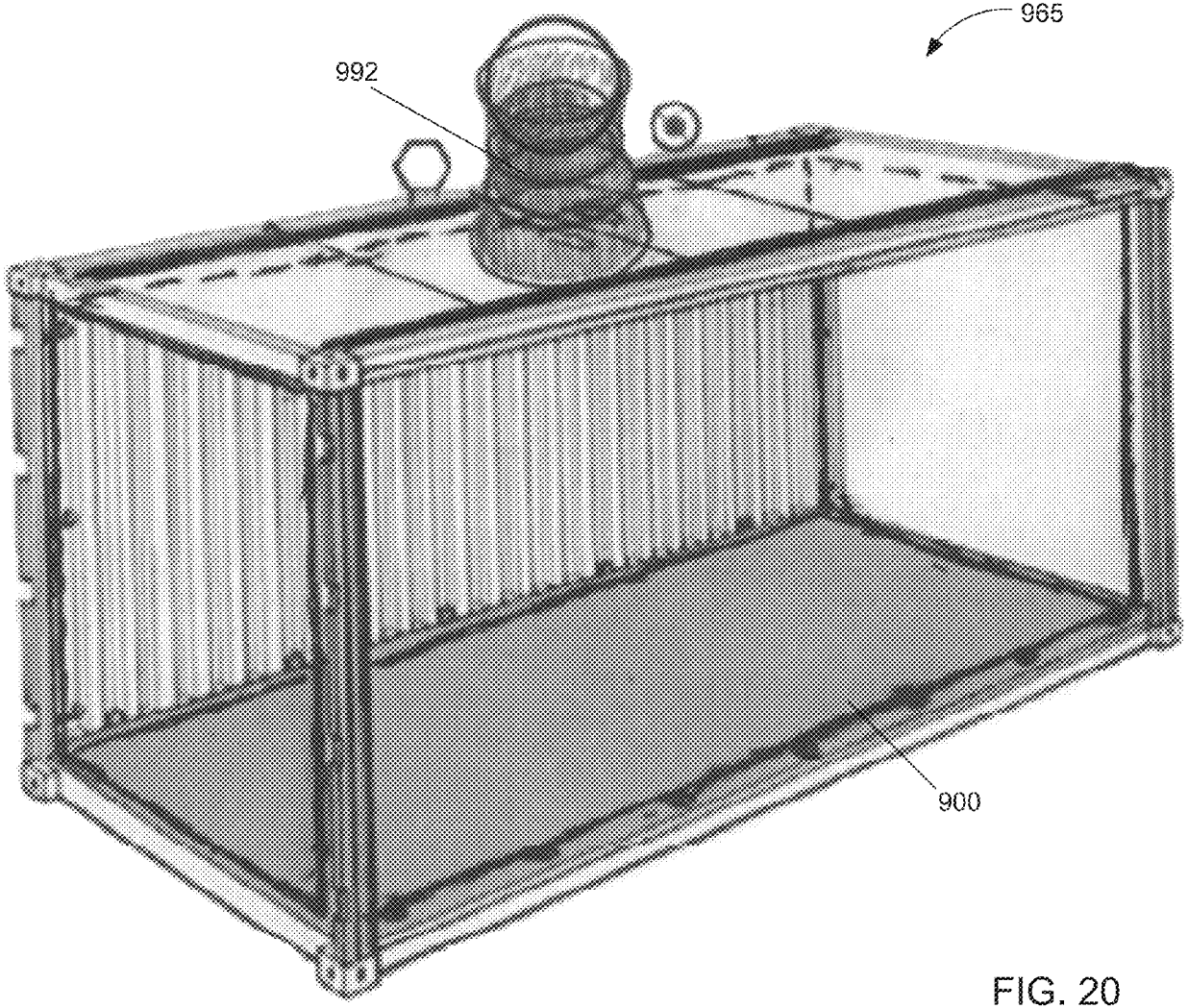
FIG. 20 is a perspective view of a sliding hatch and release mechanism included in a container, according to an embodiment.

FIG. 20 is a view of a rigid container 965 showing a sliding hatch with a releasing mechanism controlled by an electrically activated sensor. The rigid container 965 can include, for example, tracks for sliding hatches. In some embodiments, a rigid container can include an automatic trip switch sensor to release or lock a sliding hatch. In some embodiments, a container can include a tracking sensor to identify whether the container is fully loaded/ fully unloaded.

Figure 21:
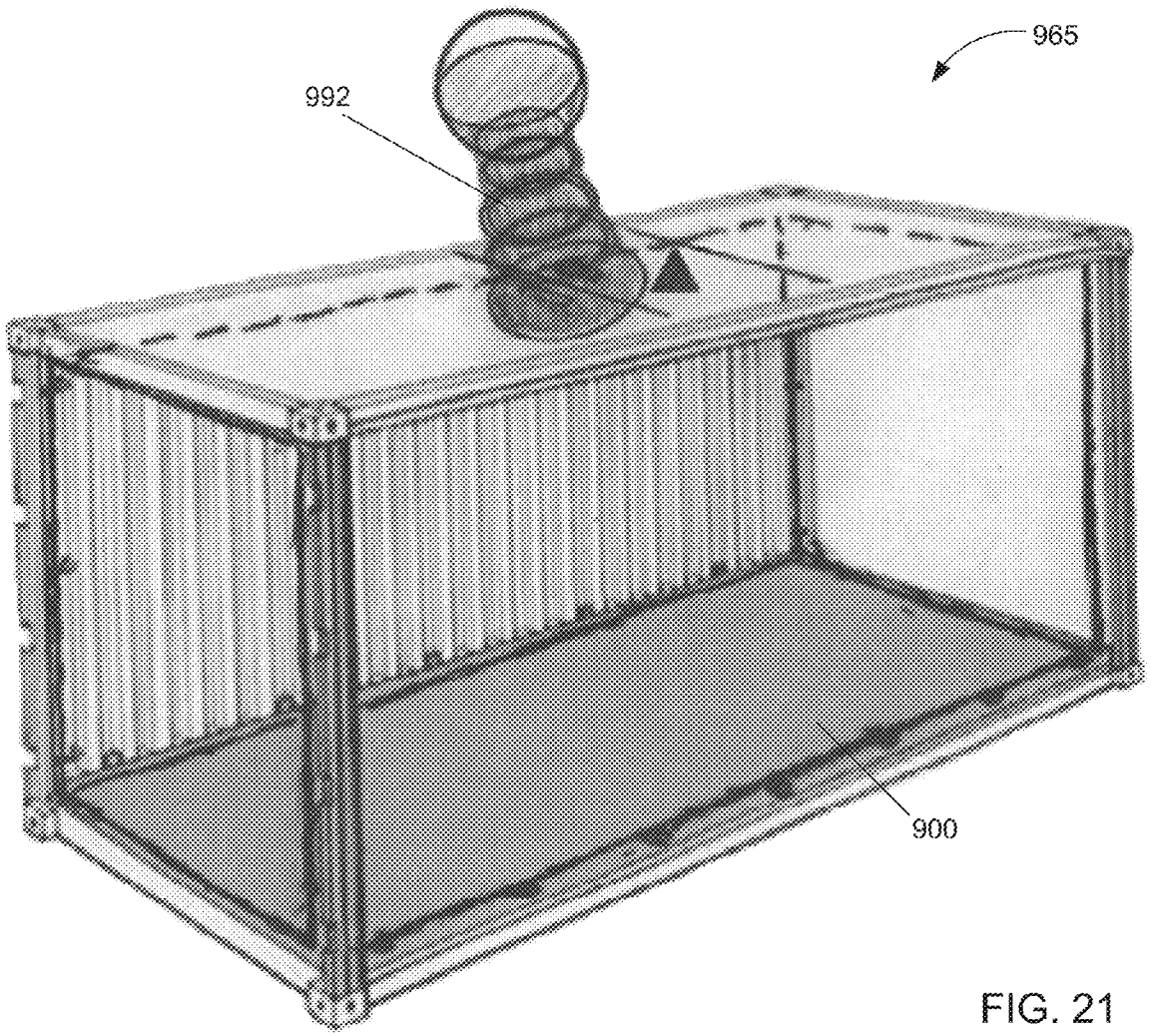
FIG. 21 is a perspective view of a loading and unloading device included in the container of FIG. 20.

FIG. 21 is a view of a rigid container 965 showing a top or bottom (or side) loading and unloading device by means of a flexible tube 992 (allowing even distribution of materials during the loading process). The loading and unloading mechanism includes a locking collar that can be coupled to the loading and unloading chute. The loading and unloading mechanism includes a sealing valve for either the exhaust of air or the introduction of inert gas.

In some embodiments, any of the containers shown and described herein can include a grounding mechanism for electrically grounding the container during the loading and/ or unloading process, as well as during transportation. For example, in some embodiments, the flexible tube 992 can include a ground wire or rod coupled thereto. The ground wire can, for example, extend from an area outside of the rigid container 965 into an interior volume defined by the rigid container 965, an inner liner and/or a flexible container disposed therein. In this manner, the static charge that can develop from the contact between particles during loading (or unloading) can be dissipated. More particularly, such static buildup can become hazardous when the materials contain, or are composed of, dust or powders (as are common with coal, ores, grain, aggregates and other bulk materials to be handled by the systems and methods described herein). In addition the ground wire or rod, in those embodiments in which the flexible container is evacuated, the evacuation reduces friction during transport and thus minimizes the formation of static charges during transport.

In some embodiments, the innermost layer of any of the containers shown and described herein is constructed of an anti static material, such as high density polyethylene, Acetal and Ester based Thermoplastic Polyurethane, amongst others. The material used on the inner layer of the liner bag can be any suitable material, generally composed of modified conductive thermoplastic compounds that allow for the rapid dissipation of static charge so that a significant electrostatic discharge event does not take place during, loading, unloading and/or transportation.

Figure 17:
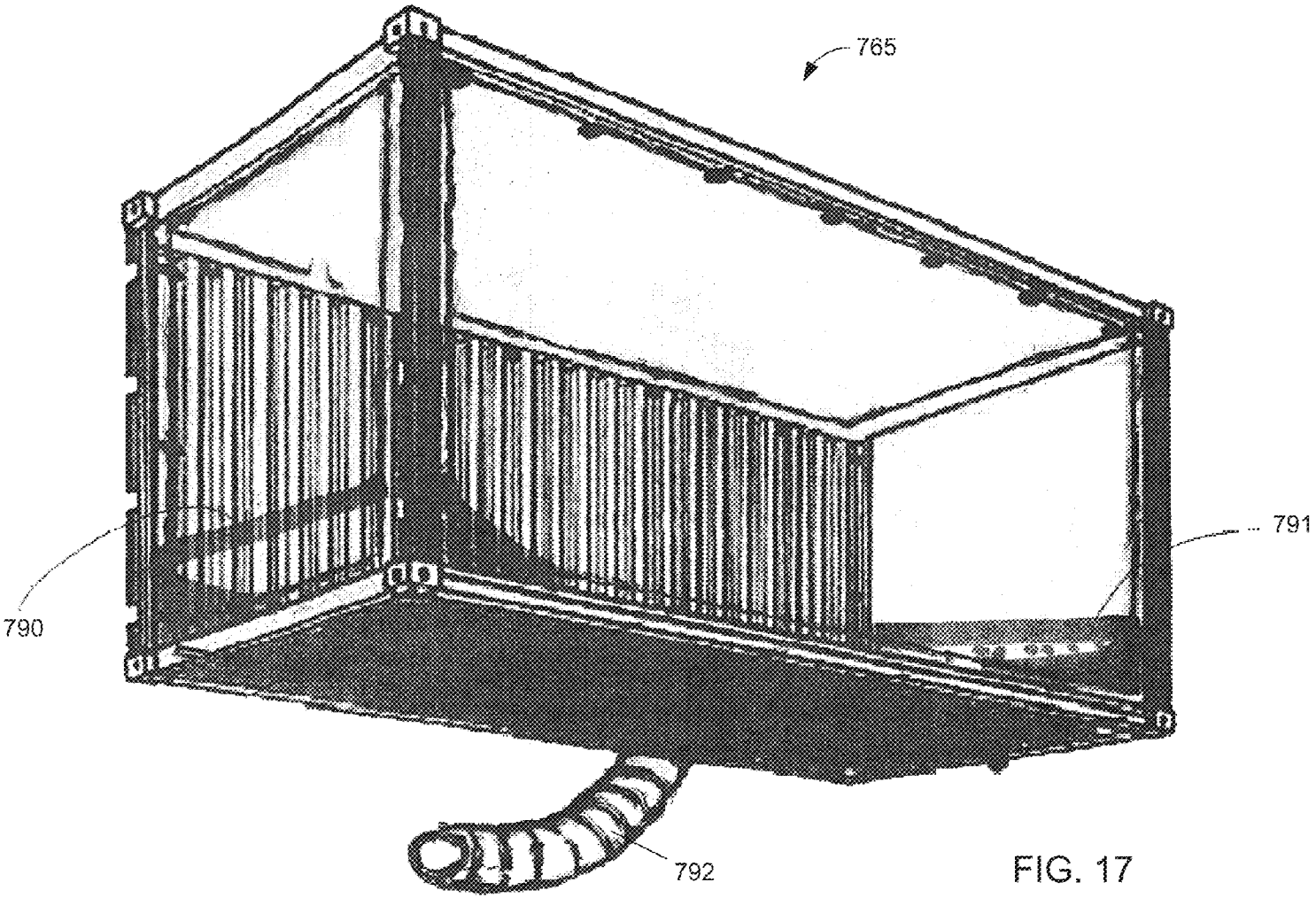
FIG. 17 is a bottom perspective view of a container, according to an embodiment.

As shown in FIG. 17, the interior of the rigid container can include a hopper shaped bottom 790, 791 which directs material be removed from the rigid container towards a portal positioned in the middle of the bottom. In this embodiment, the contents will flow from the rigid container opening. Content removal can also be assisted with a pump and hose assembly 792 or other device designed to disgorge the contents under pressure.

Unloading can also be accomplished via a portal or door on a side panel. If necessary, for unloading, one side of the rigid container could be lifted or tipped up, or the rigid container could be positioned above an unloading chute so that coal or other materials can be extracted directly into a feeding or storage mechanism utilized by the end user. A design including a side portal or door is preferred, as the same portal or door could be used for loading and unloading of the coal or other volatile material.

The liner also includes a release mechanism associated with the outlet port or door. For example, the liner can include a breakaway region, a folded flap that may be unfolded for discharge of the contents, or a release cord that opens the liner in a specific region. In such embodiments, the liner mechanism can be positioned to align with the rigid container discharge opening or mechanism.

In some embodiments, a collapsible bag, such as the flexible container 300, is utilized as the liner. In such embodiments a sealable flap or a puncturable area can be opened when the rigid container is opened, such as with a sliding or hinged door. In the alternative, the bag could have a portal or series of portals aligned with the rigid container openings. These portals could also be attached to an external hose, such that, when connected to the hose, the contents of the bag could be removed.

An alternative embodiment entails a connection between the bag and the interior or exterior of the rigid container, which could assist in removal of the contents.

In some embodiments, the rigid containerization of powdered, granulated or other processed coal, or raw coal, is such that large-scale rigid containerized transport ships can efficiently and safely transport the material to multiple end-users in multiple destinations. This allows for "on demand" transport of commodities to higher value markets and/or flexible distribution decision strategies for trading companies. Some embodiments can also be used for transport of other volatile and non-volatile materials in powdered, granular and/or other solid forms.

Although certain embodiments are shown and described as being used to contain raw coal, any of the embodiments herein can be used to contain processed coal and/or other bulk materials. For example, in some embodiments, a method includes processing coal or other products into value added material at the location where it is mined, or another location, before being loaded onto ships for transport to end users. The processed coal can then be loaded into a sealed, non-combustible rigid container, for environmentally safe transport by land or sea. The sealed rigid containers can also store the coal (or other processed materials) such that the contents are not exposed to wind and rain, preventing product deterioration, product loss, and dispersion of potentially harmful dust and other materials into the air or land through leaching or exposure to the elements. By processing coal before shipping, and transporting processed coal in sealed shipping containers, different coal products can be distributed to multiple users in different locations with relative ease. Thus, coal can be marketed and supplied in a much wider variety of formats than are currently available.

In this manner, the methods and systems described herein allow for the trade in Lingnite Coal. Lignite coal has a very high moisture content causing its energy content (BTU per pound) to be relatively low when compared with other types of coal (e.g., Bituminous, Sub-Bituminous and Anthracite). Thus, it is not practical to transport Lignite coal (either nationally or internationally) using known methods. As a result, sites containing Lignite deposits generally have electrical generating or concrete manufacturing plants constructed thereon. According to the methods described herein, Lignite coal can be processed at the mine to remove the moisture and pulverize the coal, thereby producing a processed coal having a higher energy content. Using the systems and methods described herein, the processed Lignite coal can be economically packaged, handled and shipped.

Although certain embodiments are shown and described as being used to contain coal, any of the embodiments herein can be used to contain and/or transport any suitable bulk materials. Such bulk materials can include, for example, the following ores: Argentite, Azurite, Barite, Bauxite, Bornite, Calcite, Cassiterite, Chalcocite, Chalcopyrite, Chromite, Cinnabar, Cobaltite, Columbite-Tantalite or Coltan, Cuprite, Dolomite, Feldspar, Galena, Gold, Gypsum, Hematite, Ilmenite, Magnetite, Malachite, Molybdenite, Pentlandite, Pyrolusite, Scheelite, Sphalerite, Talc, Uraninite, Wolframite. In other embodiments, such bulk materials can include grains (either raw or processed). Grains that can be packaged and transported according to the methods described herein include corn, wheat, soybean, oats or the like. Moreover, processed grain products, such as flour, can also be packaged and transported according to the methods described herein.

Any of the systems and containers described herein can be loaded and unloaded onto containerized ships, using conventional container loading and transportation equipment. The loading and unloading of bulk materials according to the systems and methods described herein avoids the cost and/or hazards associated with bulk shipping and storage of volatile materials, and reduces the amount of product lost in the environment. Shipment of materials according to the systems and methods described herein also permits the transport of materials through larger vessels, capable of transporting larger quantities of coal than bulk carriers. Thus, containerized shipping can decrease transportation costs associated with known methods of coal shipment.

Furthermore, some embodiments provide for control over the weight and/or density of the coal pile. By limiting the weight and/or density of the coal pile, and by providing a non-reactive surface and a controlled atmosphere, the risk of spontaneous combustion can be minimized. Further, the risk of a chemical reaction between the coal and the containment vessel is minimized.

Transport of containerized coal according to the systems and methods described herein is environmentally safe when compared to known bulk transport methods, since the coal is not repeatedly exposed to the air and weather, and the creation and release of coal dust is minimized. In addition, embodiments described herein also serve to reduce inefficiency in the trade imbalance. The imbalance in trade between various countries and regions, more particularly between Asia and the United States, and most particularly between China and the Unites States has for many years resulted in a surplus of containers in the United States. In particular, there remains significant unused container ship capacity from the economic crises of 2008 crash. Moreover, slowing manufacturing and exports from the U.S. have created an excess of shipping containers in the U.S. By streamlining the transportation process, and using retrofit systems for sealing existing used cargo containers, embodiments described herein will provide a means of returning cargo containers to Asia, including China, reducing the number of unused containers in the U.S. Some embodiments also provide a means for re-using containers in the transport of other goods to the United States. Thus, rather than using containers one time, or shipping empty containers back to Asia for re-use, some embodiments enable reuse of containers back and forth between the U.S. and Asia.

Figure 22:
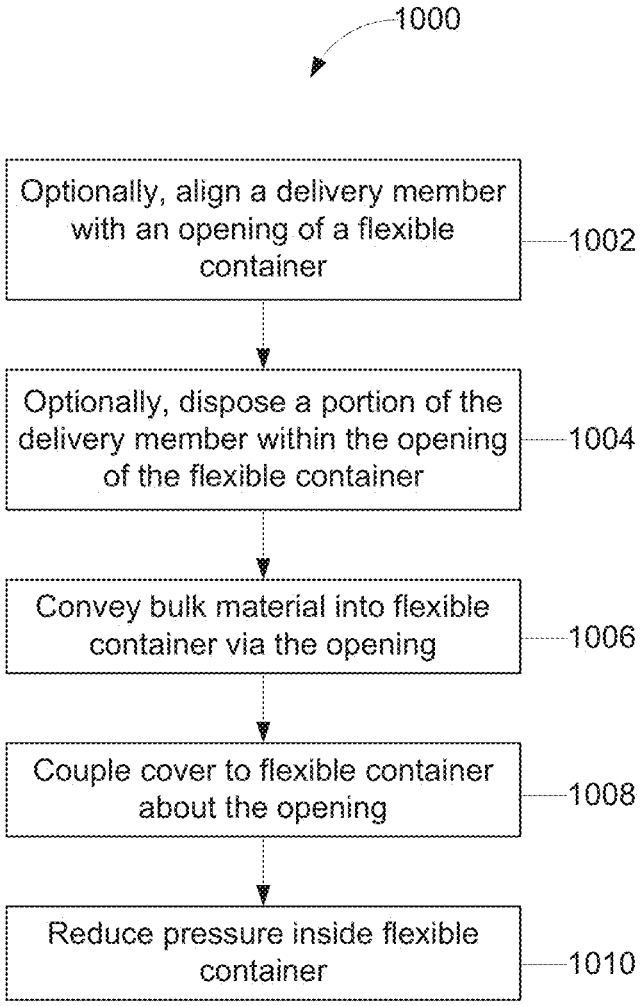
FIG. 22 is a flowchart illustrating a method for storing and transporting a bulk material, according to an embodiment.

FIG. 22 is a flowchart illustrating a method 1000 for storing and/or transporting a bulk material, according to an embodiment. In some embodiments, the bulk material is stored and/or transported in a flexible container such as, for example, any of the flexible containers described herein. In such embodiments, the flexible container can include a container body and a cover and can be configured to move between an expanded configuration and a collapsed configuration. The flexible container further includes a side wall and defines an interior volume within the container body. In some embodiments, the side wall can include a substantially non-circular opening configured to receive a bulk material. In some embodiments, the flexible container is substantially similar to the flexible container 300 described herein with reference to FIGS. 6-13. While not explicitly described, the flexible container can include any features included in the flexible container 300 and or any other embodiment described herein.

In some embodiments, the method 1000 optionally includes aligning a delivery member with the opening defined by the side wall of the flexible container, at 1002. The delivery member can be any suitable member. For example, in some embodiments, the delivery member is a conveyer. In some embodiments, a portion of the delivery member is disposed through the opening defined by the side wall and is disposed within the interior volume of the container body, at 1004. In some embodiments, the method 1000 can include conveying a gas from a volume outside the flexible container to maintain the container in the expanded configuration. In some embodiments, the gas can be an inert gas. In other embodiments, the gas can be air. In some embodiments, the inflation fluid can be conveyed into the flexible container via the same opening through which the bulk material is conveyed.

The method includes conveying the bulk material into the flexible container via an opening therein, at 1006. In some embodiments, the delivery member can be disposed within the interior volume such that at least a portion of the delivery member is disposed at a rear portion of the interior volume. In this manner, the delivery member can transfer the bulk material through the opening and into the rear portion of the interior volume of the container body. While transferring the bulk material into the interior volume of the container body, in some embodiments, the delivery member can be configured to telescope such that a length of the delivery member disposed within the interior volume is reduced. Similarly stated, the delivery member can retract at a given rate through the opening. Thus, the bulk material (e.g., processed coal) can be loaded in a rear to front manner. Said another way, the telescopic motion of the delivery member toward the opening is configured to even distribute the bulk material within the interior volume. In some embodiments, the method 1000 includes filling the interior volume with the bulk material to a predetermined volume and/or weight. For example, in some embodiments, the method 1000 includes filling the flexible container until the flexible container is approximately 60 percent full (by volume when compared to the volume of the flexible container in the expanded configuration). In other embodiments, the flexible container can be filled to any suitable level. For example, in some embodiments, the flexible container can be filled to a volume ratio of approximately 50 percent, 55 percent, 65 percent, 75 percent, 85 percent, or more.

With the desired amount of bulk material transferred to the interior volume of the flexible container, the delivery member can be retracted through the opening defined by the side wall. With the delivery member retracted, the cover included in the flexible container can be disposed about the opening and coupled to the side wall, at 1008. For example, in some embodiments the cover can be coupled to the side wall via an adhesive strip. In other embodiments, the cover can be coupled to the flexible container in any suitable manner. In some embodiments, the coupling of the cover to the side wall places the interior volume in fluidic isolation with a volume outside the flexible container. Similarly stated, the cover can be coupled to the side wall to define a fluidic seal.

With the cover coupled to the side wall and disposed about the opening the pressure within the interior volume can be reduced, thereby moving the flexible container from the expanded configuration to the collapsed configuration, at 1010. More specifically, container body and the cover can be placed in the collapsed configuration by evacuating a gas within the interior volume via a port. In some embodiments, the cover defines the port. In other embodiments, the container body or the side wall can define the port. In this manner, the port can be engaged by, for example, a vacuum source such that the pressure within the interior volume of the container body is reduced. The reduction of the pressure within the interior volume can be such that container body deforms. Similarly stated, the vacuum source can exert a suction force on the interior volume thereby urging at least a portion of the container body to deform under the force. Furthermore, the vacuum source can be configured to expose interior volume to the suction force such that the interior volume is substantially devoid of a gas (e.g., air). Said another way, the interior volume is exposed to a negative pressure and thereby urges the container body to substantially conform to a contour of the bulk material disposed therein.

In some embodiments, the flexible container can collapse (e.g., conform to the bulk material) such that the bulk material disposed within the container body can act as a substantially solid mass. For example, in some embodiments, the flexible container can collapse such that a distance between adjacent portions and/or constituents of a bulk material is reduced. In this manner, the movement of specific parts (e.g., particles, pellets, grains, chunks, portions, and/or the like) of the bulk material is reduced relative to adjacent parts of the bulk material. Thus, the potential of load shifting within the flexible container is reduced. In some embodiments, the substantial evacuation of the gas (e.g., air) within the flexible container can reduce the risk of spontaneous combustion of the bulk material (e.g., coal).

Figure 23:
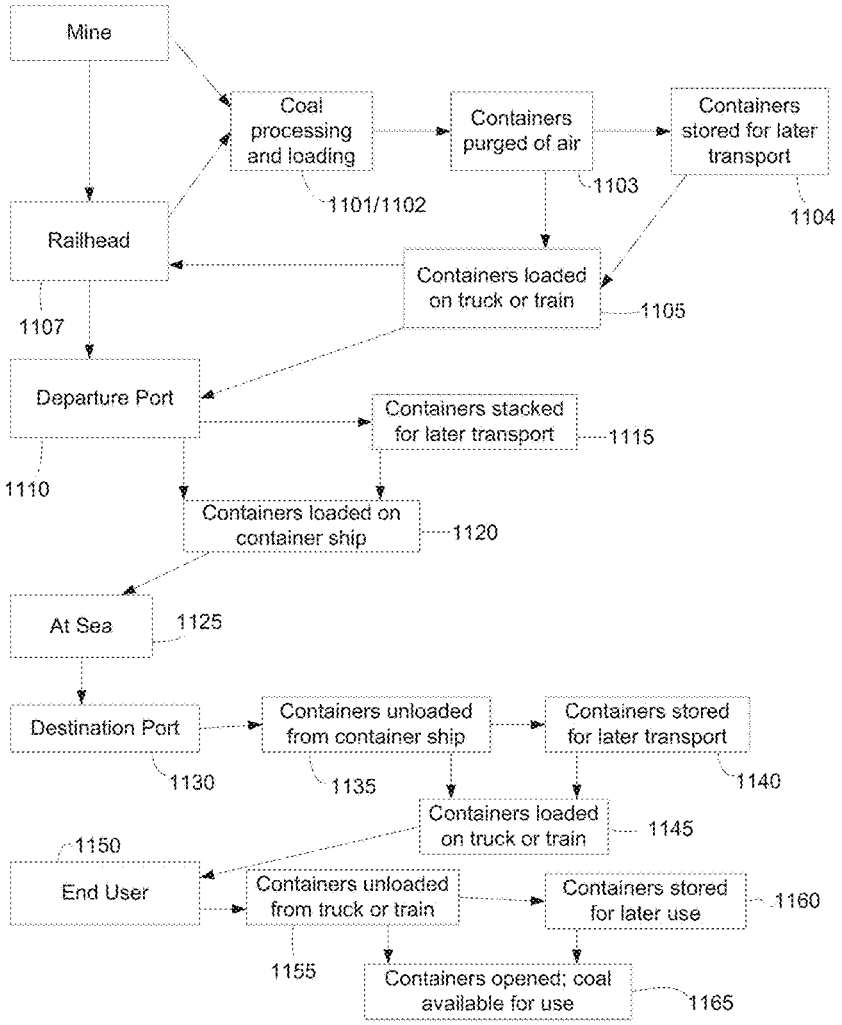
FIG. 23 is a flowchart illustrating a method for transporting a bulk material, according to an embodiment.

FIG. 23 is a flowchart illustrating a method 1100 for processing coal at the mine or railhead, at 1101. At either location, the coal can be processed into crushed, granulated or powder form, and graded by a variety of factors, such as quantity, type, size, moisture content, and ash content.

Processing can also entail mixing of different grades of coal (BTU content), in order to achieve specialized coal products for particular end users.

Additionally, the processing can include coal washing and drying to meet enhanced end user specifications. At the time of processing, the coal can be loaded into sealed containers 1102. The containers can be loaded according to any of the methods described herein. Moreover, the container can be any of the containers described herein. After loading, the containers can be purged of air, and, if desired, filled with an inert or other gas that reduces the risk of combustion 1103. The filled, sealed, and oxygen purged containers can be stored for later transport, at 1104. Loaded, sealed containers may also be placed on trucks 1105, for delivery to a railhead 1107, where the containers are loaded directly onto railcars designed for transport of cargo containers. In the alternative, the containers may be loaded onto railcars 1105 for direct transport to ports that handle containerized cargo 1110. At the port, the sealed containers can be stored 1115 until scheduled for sea transport, when they may be loaded onto mid- to large-sized container ships 1120.

After loading on a ship 1120, the containerized material is transported via sea 1125 to a destination port 1130, where the containers are unloaded 1135. Once unloaded, the containers can be stored for future transport 1140, or immediately loaded onto railcars or trucks 1145 for transport to the end user 1150. Once the containers arrive at the end user location they are unloaded form the transport means 1155, and may be stored until needed 1160, or opened such that the contents are made available for immediate use 1165.

In some embodiments, a shipping container for the transportation of granular materials includes a load- carrying space which is sealable to prevent ingress and egress of gas. In some embodiments, the load-carrying space is provided by a liner positioned within the shipping container. In some embodiments, the liner is removable from the container. In some embodiments, the liner can be formed of a polymer material. In some embodiments, the liner is a flexible bag. In other embodiments, the liner is a collapsible box. In still other embodiments, the liner is coated on the interior of the shipping container. In such embodiments, the liner is formed of a material that is non-reactive with coal. In some embodiments, the liner has a thickness in the range 1.27 cm to 1.91 cm (0.5 to 0.75 inches).

In some embodiments, a shipping container includes a sealable loading port for loading granular materials into the load-carrying space. In some embodiments, the shipping container includes a port for extracting gasses from the load-carrying space, or injecting gasses into the load-carrying space. The port can be configured for connection to a vacuum source for evacuation of gasses from the load-carrying space. The port can be configured for connection to a source of inert gas for injecting inert gas into the load-carrying space. In some embodiments, the shipping container is a twenty-foot equivalent container.

In some embodiments, a method of transporting granular material includes loading the granular material into a container. The method can further include sealing the load-carrying space and extracting gas from the load carrying space to reduce the pressure in the load-carrying space to substantially below atmospheric pressure. In some embodiments, the method includes injecting an inert gas into the load-carrying space to purge air from the load-carrying space.

While embodiments herein have been described with reference to the transportation of coal, other materials may be transported utilizing the same systems and methods to obtain comparable advantages. For example the system and method may be suitable for transporting Potash. Potash is a mined and processed mineral used primarily as fertilizer. Unlike coal, potash is not combustible yet has specific chemical characteristics that have significant transport and storage challenges. Embodiments described herein effectively meets those issues and do so in a more efficient manner than current methods and/or technologies.

Potash is commonly transported in crystalline form. These crystals are extremely sensitive to humidity and moisture, forming clumps and "pan caking" when exposed to humidity and moisture. Current transport requires specialized rail cars and truck bodies that keep the potash from coming into contact with water. These specialized vehicles are expensive and require considerable maintenance. Current storage facilities, at the processing plant, at both sending and receiving ports and distribution centers are specialized and expensive to construct. Current handling methods and facilities at all the above steps are costly to build and maintain. By applying the technology described herein to potash, transport becomes more efficient, storage will not require expensive facilities, handling at ports and distribution centers will be more efficient and cheaper and ocean transport will be scalable, more flexible, cheaper and much more efficient.

In some embodiments, the bulk material can be processed at or near the mine. For example, processing may include milling to produce granular or powdered coal of a specific size desired by an end user. Processing may also entail washing or chemical processing to remove undesirable materials and gases, or drying to produce material with specified, known water content. Examples of pulverizing equipment that may be utilized include mills such as the ball and tube mill or the bowl mill. By processing the coal at the mine, at the rail-head or elsewhere in the supply chain, the coal may be supplied in the exact form specified by the end user, such that the coal need not be processed by the end user before it is consumed. For a power plant, this means that the supplied coal can be fed directly into the power generation furnace or boiler, avoiding the need for complex milling and drying equipment. Thus, the plant operator need not install, maintain or operate such equipment, significantly reducing operating costs and plant size. The plant operator may also reduce environmental risks and issues, as coal may be stored in containers until needed, rather than in open piles. As contemplated herein, coal may be supplied in the following forms: raw lump, granulate, or powder, or mixed with higher or lower BTU coal to end user specifications.

Figure 24:
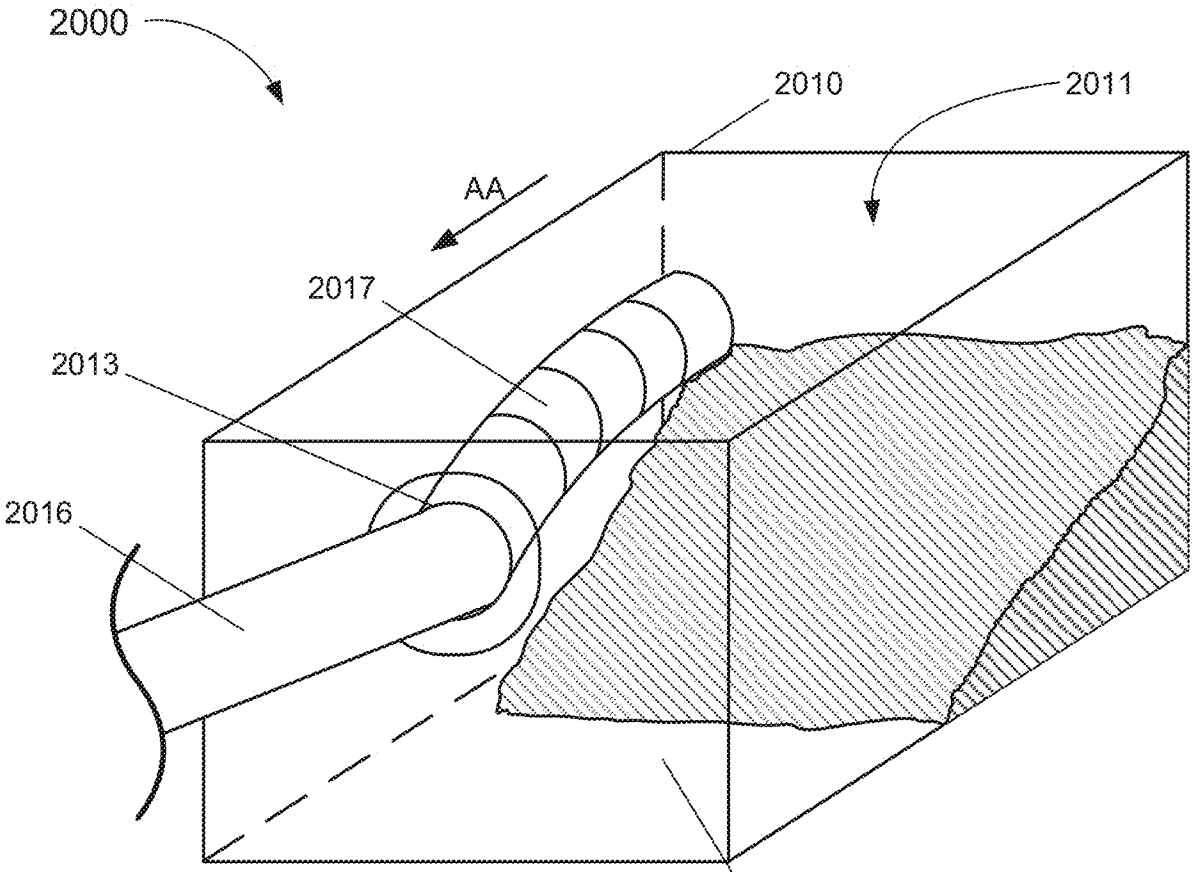
FIG. 24 is a perspective view of a flexible container, according to an embodiment.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above For example, in reference to FIGS. 1-3, while the flexible container 100 is shown as receiving the conveyer C, in other embodiments, a flexible container can receive any suitable delivery member. In other embodiments, a container can include a portion of a delivery member therein. For example, as shown in FIG. 24, a flexible container 2000 includes a container body 2010 and a side wall 2012. The container body 2010 defines an interior volume 2011 and is configured to house, at least partially, an internal chute 2017. The side wall 2012 defines an opening 2013 configured to be aligned with the internal chute 2017. Furthermore, a delivery hose

2016 can be configured to couple to the side wall 2012 such that the delivery hose 2016 and the internal chute 2017 are in fluid communication. In this manner, the delivery hose 2016 can be configured to transfer, for example, a pulverized (e.g., processed) coal. In addition, the internal chute 2017 can be configured to telescope in the direction of the arrow AA (e.g., mechanically and/or electrically) such that the processed coal is loaded into the flexible container 2000 from the rear forward. Thus, the weight distribution of the processed coal can be controlled.

Where schematics and/or embodiments described above indicate certain components arranged in certain orientations /or positions, the arrangement of components may be modified. Similarly, where methods and/or events described above indicate certain events and/or procedures occurring in certain order, the ordering of certain events and/or procedures may be modified. While the embodiments have been particularly shown and described, it will be understood that various changes in form and details may be made.

For example, although the flexible container 300 is shown and described as including a bulkhead 325 that includes a sleeve 321 that receives a shock absorbing member, in other embodiments, the flexible container 300 need not include a bulkhead 300. For example, in some embodiments, the flexible container 300 can be disposed and/or coupled within a rigid shipping container to form a shipping system that is devoid of a dunnage bag, bulwark, bulkhead and/or any other mechanism for absorbing a load produced by the movement of the bulk material within the flexible container 300. In particular, as described above, when the flexible container 300 is moved from the expanded configuration to the collapsed configuration, the bulk material therein can be moved from a flowable (or partially flowable) state to a substantially non-flowable state. Thus, the potential of load shifting of the bulk material within the flexible container 300 is reduced and/or eliminated. Accordingly, the flexible container 300 can be coupled within a rigid container solely with a tether or strap (i.e., without the need for a bulwark, dunnage bag or the like).

Conversely, although the flexible container 300 is shown and described as including a bulkhead 325 that is constructed separately from and later attached to a container body, in other embodiments, a flexible container can include an integrated bulkhead, dunnage system or the like. For example, in some embodiments, a flexible container can include an inflatable portion (e.g., towards the rear or front thereof) configured to be inflated in conjunction with loading the flexible container with the bulk material. In this manner, the flexible container can provide additional protection to the rigid container within which it is disposed. Similarly stated, this arrangement can obviate the need for external dunnage bags, bulwark systems or the like.

Although various embodiments have been described as having particular features and/or combinations of components, other embodiments are possible having a combination of any features and/or components from any of embodiments as discussed above. For example, any of the rigid containers described herein can include any of the flexible containers described herein.

What is claimed is:

1. An apparatus, comprising:

a container body configured to be disposed within a rigid shipping container, the container body having a horizontal midplane with a first portion disposed on a first side of the horizontal midpiane and a second portion disposed on a second side of the horizontal midplane, the first portion constructed from a first flexible material having a first stiffness, the second portion constructed from a second flexible material having a second stiffness less than the first stiffness, the first portion being coupled to the second portion substantially at the horizontal midplane, the container body including a side wall defining an opening along the second portion of the container body, the container body defining an interior volume configured to contain a bulk material disposed therein via the opening when the container body is in an expanded configuration; and a cover configured to be coupled to the side wall of the container body about the opening to fluidically isolate the interior volume from a volume outside of the container body, the cover constructed from a flexible material, the container body configured to be evacuated when the bulk material is disposed in the interior volume to place the container body and the cover in a collapsed configuration, the container body configured to transition the bulk material from a flowable state to a non-flowable state when placed in the collapsed configuration.

2. The apparatus of claim 1, wherein the cover and the side wall form a substantially planar surface when the container body and the cover are collectively in an expanded configuration.

3. The apparatus of claim 1, wherein at least one of the container body or the cover defines a port, the container body and the cover configured to be evacuated via the port after the bulk material is disposed within the interior volume.

4. The apparatus of claim 1, wherein at least one of the container body or the cover defines a port, the container body and the cover configured to be placed in a collapsed configuration via reducing a pressure within the interior volume via the port.

5. The apparatus of claim 1, wherein the opening has a noncircular shape.

6. The apparatus of claim 1, wherein the cover is coupled to the side wall about the opening via at least one of an adhesive bond or a zipper.

7. The apparatus of claim 1, wherein the container body is configured to be placed in the collapsed configuration via reducing a pressure within the interior volume, the first portion of the container body configured to deform a first amount when the container body is moved from the expanded configuration to the collapsed configuration, the second portion of the container body configured to deform a second amount when the container body is moved from the expanded configuration to the collapsed configuration, the second amount is greater than the first amount.

8. The apparatus of claim 1, wherein at least one of the first flexible material or the second flexible material from which the container body is constructed includes a first layer and a second layer.

9. The apparatus of claim 1, further comprising:

a bulkhead coupled to the side wall along the first portion of the container body, the bulkhead including a support structure configured to receive a load applied to the container body.

10. The apparatus of claim 1, wherein:

the side wall defines a sleeve disposed along the first portion of the container body and configured to receive a substantially rigid member.

11. The apparatus of claim 1, the apparatus further comprising:

a tether, a first portion of the tether coupled to the container body, a second portion of the tether configured to be coupled to the rigid shipping container, a length of the tether configured to change when the container body and the cover are moved from the expanded configuration to the collapsed configuration.

12. The apparatus of claim 1, wherein the container body is configured to be disposed in the rigid shipping container as the bulk material is disposed in the interior volume via the opening to form a shipping system, the shipping system devoid of any one of a dunnage bag or a bulwark.

13. The apparatus of claim 1, wherein the container body has a length of approximately 20 feet, a height of approximately 8 feet and a width of approximately 7.5 feet when the container body is in an expanded configuration.

14. An apparatus, comprising:

a flexible container having a horizontal midplane with a first portion disposed on a first side of the horizontal midplane and a second portion disposed on a second side of the horizontal midplane, the first portion constructed from a first material, the second portion constructed from a second material, the flexible container including a side wall, the side wall defining an opening along the second portion of the container body, the flexible container defining an interior volume configured to contain a bulk material, the flexible container configured to be placed in an expanded configuration when the bulk material is being conveyed into the interior volume via the opening, the flexible container configured to be placed in a collapsed configuration via reducing a pressure within the interior volume when the bulk material is disposed within the interior volume, the first portion of the flexible container configured to deform a first amount when the flexible container is moved from the expanded configuration to the collapsed configuration, the second portion of the flexible container configured to deform a second amount when the flexible container is moved from the expanded configuration to the collapsed configuration, the second amount being greater than the first amount, the flexible container limiting movement of the bulk material within the flexible container when in the collapsed configuration such that the bulk material forms a solid mass.

15. The apparatus of claim 14, wherein the first portion of the flexible container is a bottom portion of the flexible container, the first material having a stiffness greater than a stiffness of the second material.

16. The apparatus of claim 14, wherein the second portion of the flexible container is a top portion of the flexible container, the apparatus further comprising:

a cover configured to be coupled to the top portion of the flexible container about the opening to fluidically isolate the interior volume from a volume outside of the flexible container, the cover constructed from a flexible material.

17. The apparatus of claim 14, wherein the second portion of the flexible container is a top portion of the flexible container, the opening is a noncircular opening defined by the top portion.

18. The apparatus of claim 14, wherein the flexible container is configured to be coupled within a rigid shipping container, the apparatus further comprising:

a tether, a first portion of the tether coupled to the flexible container, a second portion of the tether configured to be coupled to the rigid shipping container, a length of the tether configured to change when the flexible container is moved from the expanded configuration to a collapsed configuration.

19. The apparatus of claim 1, wherein:

the cover is coupled to the side wall along the second portion of the container body via a zipper; and the cover defines a port, the container body configured to be evacuated via the port to place the container body and the cover in the collapsed configuration, the cover and the side wall forming a substantially planar surface when the container body and the cover are collectively in an expanded configuration.

20. The apparatus of claim 1, wherein:

the cover defines a port; and the container body and the cover configured to be placed in the collapsed configuration via reducing a pressure within the interior volume via the port after the bulk material is disposed within the interior volume, the first portion of the container body configured to deform a first amount when the container body is moved from the expanded configuration to the collapsed configuration, the second portion of the container body configured to deform a second amount when the container body is moved from the expanded configuration to the collapsed configuration, the second amount greater than the first amount.

21. A method, comprising:

conveying a bulk material into an interior volume of a flexible container via an opening defined by a side wall of the flexible container, the flexible container defining a horizontal midplane and having a first portion disposed on a first side of the horizontal midplane and a second portion disposed on a second side of the horizontal midplane, the first portion having a first stiffness, the second portion having a second stiffness less than the first stiffness, the side wall defining the opening along the second portion;

coupling a cover to the side wall and about the opening to fluidically isolate the interior volume from a volume outside of the flexible container; and reducing a pressure within the interior volume after the coupling to move the flexible container into a collapsed configuration, the first portion of the flexible container configured to deform a first amount when the flexible container is moved to the collapsed configuration, the second portion of the flexible container configured to deform a second amount when the flexible container is moved to the collapsed configuration, the second amount greater than the first amount, the flexible container limiting movement of the bulk material within the interior volume to transition the bulk material from a flowable state to a non-flowable state when the flexible container is in the collapsed configuration.

22. The method of claim 21, further comprising:

attaching a portion of the flexible container to a side wall of a rigid shipping container before the conveying; and maintaining the flexible container in an expanded configuration during the conveying the bulk material, wherein the reducing a pressure within the interior volume includes evacuating the interior volume via a port defined by the cover.

23. The method of claim 21, further comprising:

aligning a delivery member with the opening, the delivery member configured to convey the bulk material into the interior volume via the opening.

24. The method of claim 21, further comprising:

disposing at least a portion of a delivery member within the interior volume via the opening, the delivery member configured to convey the bulk material into the interior volume.

25. The method of claim 21, further comprising:

conveying a gas into the interior volume via the opening to maintain the flexible container in an expanded configuration during the conveying the bulk material.

26. The method of claim 21, further comprising:

aligning a delivery member with the opening such that the interior volume is in fluid communication with a volume outside of the flexible container, the delivery member configured to convey the bulk material into the interior volume via the opening; and conveying a gas from the volume outside the flexible container into the interior volume via the opening to maintain the flexible container in an expanded configuration during the conveying the bulk material.

27. The method of claim 21, further comprising:

conveying a gas into the interior volume via the opening to maintain the flexible container in an expanded configuration; and conveying a portion of the gas from the interior volume via the opening during the conveying the bulk material.

28. The method of claim 21, wherein:

the cover is constructed from a flexible material; and the coupling includes coupling the cover about the opening via a zipper.

29. The method of claim 21, wherein the opening is a first opening, the flexible container is devoid of a second opening.

30. The method of claim 21, wherein the opening has a noncircular shape.

31. The method of claim 21, wherein the bulk material includes coal.

32. The method of claim 21, wherein the bulk material is a powdered substance, the powdered substance forming a substantially solid block when the flexible container is in the collapsed configuration.

33. The method of claim 21, wherein the flexible container is disposed within a substantially rigid container to form a shipping system, the shipping system devoid of any one of a dunnage bag or a bulwark.

* * * * *